US007219064B2

(12) United States Patent
Nakakita et al.

(10) Patent No.: US 7,219,064 B2
(45) Date of Patent: May 15, 2007

(54) LEGGED ROBOT, LEGGED ROBOT BEHAVIOR CONTROL METHOD, AND STORAGE MEDIUM

(75) Inventors: Hideki Nakakita, Kanagawa (JP); Tomoaki Kasuga, Tokyo (JP)

(73) Assignee: Sony Corporation, Tokyo (JP)

( * ) Notice: Subject to any disclaimer, the term of this patent is extended or adjusted under 35 U.S.C. 154(b) by 878 days.

(21) Appl. No.: 10/168,740

(22) PCT Filed: Oct. 23, 2001

(86) PCT No.: PCT/JP01/09285

§ 371 (c)(1),
(2), (4) Date: Nov. 18, 2002

(87) PCT Pub. No.: WO02/34478

PCT Pub. Date: May 2, 2002

(65) Prior Publication Data

US 2003/0130851 A1 Jul. 10, 2003

(30) Foreign Application Priority Data

Oct. 23, 2000 (JP) ..... 2000-322241

(51) Int. Cl.
*G10L 21/00* (2006.01)

(52) U.S. Cl. ..... 704/275; 704/261; 901/47; 901/33; 700/245; 318/568.16; 318/568.11

(58) Field of Classification Search ..... 704/270–275, 704/261; 700/245, 261, 246, 253; 901/1, 901/47, 46, 3, 5, 9, 33; 318/568.16, 568.11, 318/568.12

See application file for complete search history.

(56) References Cited

U.S. PATENT DOCUMENTS 4,278,838 A * 7/1981 Antonov ..... 704/260
4,695,975 A * 9/1987 Bedrij ..... 715/500.1
5,029,214 A * 7/1991 Hollander ..... 704/272
5,746,602 A 5/1998 Kikinis
6,330,539 B1 * 12/2001 Takayama et al. ..... 704/275
6,493,606 B2 * 12/2002 Saijo et al. ..... 700/245
6,584,377 B2 * 6/2003 Saijo et al. ..... 700/245
6,754,560 B2 * 6/2004 Fujita et al. ..... 700/245

FOREIGN PATENT DOCUMENTS

EP 2 227 183 7/1990

(Continued)

*Primary Examiner*—Vijay Chawan
(74) *Attorney, Agent, or Firm*—Frommer Lawrence & Haug LLP; William S. Frommer; Thomas F. Presson

(57) ABSTRACT

To provide a robot which autonomously forms and performs an action plan in response to external factors without direct command input from an operator.

When reading a story printed in a book or other print media or recorded in recording media or when reading a story downloaded through a network, the robot does not simply read every single word as it is written. Instead, the robot uses external factors, such as a change of time, a change of season, or a change in a user's mood, and dynamically alters the story as long as the changed contents are substantially the same as the original contents. As a result, the robot can read aloud the story whose contents would differ every time the story is read.

21 Claims, 19 Drawing Sheets

FOREIGN PATENT DOCUMENTS

| | | |
|---|---|---|
| JP | 61-167997 | 7/1986 |
| JP | 7-178257 | 7/1995 |
| JP | 8-202252 | 8/1996 |
| JP | 9-131468 | 5/1997 |
| JP | 2000-155750 | 6/2000 |
| JP | 2000-210886 | 8/2000 |

* cited by examiner

FIG. 12

| Morning Version: | Noon Version: | Night Version: | Midnight Version: |
|---|---|---|---|
| SCENE 1 | SCENE 1 | SCENE 1 | SCENE 1 |
| ☻Good morning! Did you sleep well? Morning is my favorite time.<br>☻So, I will tell you a fun story! | ☻I like this time of day in the afternoon.<br>☻This is the perfect time to read. So, listen to my story. | ☻Oops, it's already night. How was your day?<br>☻I'll tell you a story before you go to bed. Then, I'll go to bed. | ☻Oh, are you still awake? I'm so sleepy. Do you wanna listen to my story?<br>☻But I might fall asleep before I finish. |
| Once upon a time, one early afternoon, Blue was about to take a nap when he received a letter from his friend.<br>(Friend) "Hi, Blue! How are you? The circus is coming to town! Don't you want to come with me?"<br>(Blue) "Oh, it's no time to sleep."<br>(Blue) "But what is the circus then?" | Once upon a time, one early afternoon, when Blue was taking a nap, he received a letter from his friend.<br>(Friend) "Hi, Blue! How are you? The circus is coming to town! Don't you want to come with me?"<br>(Blue) "Oh, it's no time to sleep."<br>(Blue) "But what is the circus then?" | Once upon a time, one early afternoon, when Blue was taking a nap, he received a letter from his friend.<br>(Friend) "Hi, Blue! How are you? The circus is coming to town! Don't you want to come with me?"<br>(Blue) "Oh, it's no time to sleep."<br>(Blue) "But what is the circus then?" | Once upon a time, one early afternoon, when Blue was taking a nap, he received a letter from his friend.<br>(Friend) "Hi, Blue! How are you? The circus is coming to town! Don't you want to come with me?"<br>(Blue) "Oh, it's no time to sleep."<br>(Blue) "But what is the circus then?" |

FIG. 13

SCENE 2
The circus is just over that mountain.
Oh, my goodness!
It's a wonderful day today!
(Blue) "I might not go straight back home."
Yes, Blue loves strolling.

No, Blue! You must go straight back home.
(Blue) "Hello, Mr. Fish!"
(Fish hurriedly) "Hello, Blue! What? Anything wrong?"
[Author: Always-hurrying Mr. Fish does not have to speak hurriedly.
Mr. Fish should speak clearly to force Blue to obey him.]
Mr. Fish is always in hurry.
(Fish hurriedly) "Would you like some tea?"
(Blue) "I'd love to, but I can't go into the water."
(Fish) "Yes you can. Have some tea at my place."
(Blue) "Well, let me think..."
(Fish hurriedly) "I'll make some tea for you."
Mr. Fish starts making tea. However, tea is mixed with water in the water.
(Fish hurriedly) "Which portion is tea and which portion is water?"
Mr. Fish is in panic.
(Fish hurriedly) "Blue, hurry up! This portion right here is tea, so drink it up. Oh, right here, here, here..."
[Author: I think this is a difficult part, so please practice hard.]
Mr. Fish is gone, following the tea.
(Blue) "Oh, I have to go straight back home! Sorry, but next time."
Blue finally remembered about the circus.
The circus is just there out of the tunnel!
But in the tunnel...

SCENE 2
The circus is just over that mountain.
Oh, my goodness!
It's a wonderful day today!
(Blue) "I might not go straight back home."
Yes, Blue loves strolling.

No, Blue! You must go straight back home.
(Blue) "Hello, Mr. Fish!"
(Fish slowly) "Oh, Blue, is anything wrong?"
Mr. Fish is always at ease.
(Fish slowly) "Come over to my place. Would you like some cookies?"
(Blue livelily) "Yes, I love cookies."
Blue answered happily.
(Fish slowly) "OK. I'll treat you with my cookies. First, I need flour, butter, and..."
(Blue) "What? Are you gonna make them from the beginning?"
(Fish slowly) "Eggs maybe? Well, wait here for a while. I'll check the recipe in the book."
Mr. Fish started reading the recipe book.
Mr. Fish seems to forget that Blue was there.
(Blue) "Oh, I have to go straight back home!"
Blue finally remembered about the circus.
(Blue) "Sorry, Mr. Fish. When cookies are ready, I'll stop by again."
The circus is just there out of the tunnel!
But in the tunnel...

SCENE 2
The circus is just over that mountain.
Oh, my goodness!
It's a wonderful day today!
(Blue) "I might not go straight back home."
Yes, Blue loves strolling.

No, Blue! You must go straight back home.
(Blue) "Hello, Mr. Fish!"
(Fish) "What? Don't bother me."
Mr. Fish seems to be in a bad mood.
(Fish) "Don't take it for granted that you'll be treated like a guest. I won't give you tea or cookies.
(Blue) "That's OK. I'm savoring the stroll"
(Please say "savoring" clearly and slowly here.)
(Fish) "What?"
Mr. Fish was surprised.
(Fish) "What? What are you savoring? No, you can't savor anything without my permission. No, no, no!"
[Author: I think this is a difficult part, so please practice hard.]
Mr. Fish started reading the recipe book.
Mr. Fish was upset that Blue has eaten something without his permission.
(Blue) "Why is he so upset? Oh, I have to go straight back home!"
Blue finally remembered about the circus.
The circus is just there out of the tunnel!
But in the tunnel...

SCENE 2
The circus is just over that mountain.
Oh, my goodness!
It's a wonderful day today!
(Blue) "I might not go straight back home."
Yes, Blue loves strolling.

No, Blue! You must go straight back home.
(Snores coming from somewhere)
Zzz, zzz, zzz.
Oops, sorry. I fell asleep.
Well, how far have I told you?
Yes, about Blue taking the stroll.
(Blue) "Oh, I have to go straight back home!"
Blue finally remembered about the circus.
The circus is just there out of the tunnel!
But in the tunnel...

FIG. 14

SCENE 3

(Preferably echoes should be reverberated in Scene 3, particularly at the last phrase "Hey, wait for me!")
(Ghost) "He-he-he...we are ghosts. We love dark, damp places."
In the tunnel were the ghosts!
(Ghost) "Hya-hya-hya..."
The ghosts laughed with scary voices.
Blue got scared and started shaking.
Noticing that, the ghost started roaring with scary voices.
(Ghost) "Wooow!!!"
Blue could not bear this any more.
He started running to the exit.
But it wasn't only Blue that was surprised.
The other ghosts were also surprised and ran out of the tunnel.
(slowly and reverberatively in the tunnel) "Hey, wait for me!"

FIG. 15

SCENE 4

(Friend ordinarily)
"Wait for me!"
When Blue ran out of the tunnel, his friend followed him.
(Blue) "What? What happened to everyone?"
(Friend breathlessly) "I was so afraid of the tunnel that I dressed up as a ghost."
(Blue) "I see."

(Friend) "Come on, hurry up! The circus's gonna begin."
The friend ran far away.

(Blue) "Where has everybody gone? Where is the entrance? Oh, it must be this door."

Blue finally found the door and opened it...

FIG. 16

SCENE 5

In a magic box.

(Friend A) "Oh, it's Blue! It's Blue!"
(Friend B) "He got out of the empty box!"
(Friend C) "Cool!"

Blue is a bit proud of himself.

Blue "Ha ha ha..."

The witch told Blue.

(Witch) "You did a wonderful job and the magic was a great success. Well, I'll give you a gift."

(Blue) "Really? Then, I want that ball on the top."

(Witch) "The pink ball, that's easy."

FIG. 17

SCENE 6
The witch vanished in a twinkle in the sky, leaving only her voice.
(Witch) "I've already delivered the ball to you."
(Blue) "What?"

Blue ran directly home.
As the witch told him, the pink ball has already been delivered to home.
When Blue touched the ball,
(Blue) "Oh, I'm excited!"
Yes, the ball was exciting.

The next day, Blue received a letter from his friend.
(Friend) "Please cherish the pink ball, because you can't see the circus without it."
That's why the pink ball is Blue's precious treasure.
(Blue) "But what is the circus then?"
Blue knew what the circus was about only after a while.

⊕Well, how was the story? Was it fun?
⊕Play with me next time!

SCENE 6
The witch vanished in a twinkle in the sky, leaving only her voice.
(Witch) "I've already delivered the ball to you."
(Blue) "What?"

Blue ran directly home.
As the witch told him, the pink ball has already been delivered to home.
When Blue touched the ball,
(Blue) "Oh, I'm excited!"
Yes, the ball was exciting.

The next day, Blue received a letter from his friend.
(Friend) "Please cherish the pink ball, because you can't see the circus without it."
That's why the pink ball is Blue's precious treasure.
(Blue) "But what is the circus then?"
Blue knew what the circus was about only after a while.

⊕Well, how was the story? Was it fun? Mmm.
⊕I wanna take a nap.

SCENE 6
The witch vanished in a twinkle in the sky, leaving only her voice.
(Witch) "I've already delivered the ball to you."
(Blue) "What?"

Blue ran directly home.
As the witch told him, the pink ball has already been delivered to home.
When Blue touched the ball,
(Blue) "Oh, I'm excited!"
Yes, the ball was exciting.

The next day, Blue received a letter from his friend.
(Friend) "Please cherish the pink ball, because you can't see the circus without it."
That's why the pink ball is Blue's precious treasure.
(Blue) "But what is the circus then?"
Blue knew what the circus was about only after a while.

⊕This is it for today.
Good night.
Sleep tight and sweet dreams to you.

SCENE 6
The witch vanished in a twinkle in the sky, leaving only her voice.
(Witch) "I've already delivered the ball to you."
(Blue) "What?"

Blue ran directly home.
As the witch told him, the pink ball has already been delivered to home.
When Blue touched the ball,
(Blue) "Oh, I'm excited!"
Yes, the ball was exciting.

The next day, Blue received a letter from his friend.
(Friend) "Please cherish the pink ball, because you can't see the circus without it."
That's why the pink ball is Blue's precious treasure.
(Blue) "But what is the circus then?"
Blue knew what the circus was about only after a while.

⊕This is the end.
I almost fell asleep.
⊕OK, good night...

LEGGED ROBOT, LEGGED ROBOT BEHAVIOR CONTROL METHOD, AND STORAGE MEDIUM

TECHNICAL FIELD

The present invention relates to polyarticular robots, such as legged robots having at least limbs and a trunk, to action control methods for legged robots, and to storage media. Particularly, the present invention relates to a legged robot which executes various action sequences using limbs and/or a trunk, to an action control method for the legged robot, and to a storage medium.

More specifically, the present invention relates to a legged robot of a type which autonomously forms an action plan in response to external factors without direct command input from an operator and which performs the action plan to the world, to an action control method for the legged robot, and to a storage medium. More particularly, the present invention relates to a legged robot which detects external factors, such as a change of time, a change of season, or a change in a user's mood, and transforms the action sequence while operating in cooperation with the user in a work space shared with the user, to an action control method for the legged robot, and to a storage medium.

BACKGROUND ART

Machinery which operates in a manner similar to human behavior by electrical or magnetic operation is referred to as a "robot". The etymology of the word robot is "ROBOTA (slave machine)" in Slavic. In Japan, robots became widely used in the end of the 1960s. Many of these robots are industrial robots, such as manipulators and transfer robots, designed automation and for unmanned production in factories.

Recently, research and development of the structure of legged mobile robots, including pet robots emulating the physical mechanism and the operation of quadripedal walking animals, such as dogs, cats, and bear cubs, and "human-shaped" or "human type" robots (humanoid robots) which emulate the physical mechanism and the operation of bipedal orthograde animals, such as human beings and monkeys, and stable walking control thereof have advanced. There is a growing expectation for practical applications. Although these legged mobile robots are unstable and posture control and walking control thereof are difficult compared with crawling-type robots, the legged mobile robots are superior in that they can walk and run flexibly, such as climbing up and down stairs and jumping over obstacles.

Stationary robots, such as arm robots, which are installed and used at a specific location, operate only in a fixed, local work space where they assemble and select parts. In contrast, the work space for mobile robots is limitless. Mobile robots move along a predetermined path or move freely. The mobile robots can perform, in place of human beings, predetermined or arbitrary human operations and can offer various services replacing human beings, dogs, or other living things.

One use of the legged mobile robots is to replace human beings in executing various difficult tasks in industrial and production activities. For example, the legged mobile robots can replace human beings in doing dangerous and difficult tasks, such as the maintenance of nuclear power generation plants and thermal power plants, the transfer and assembly of parts at production factories, cleaning skyscrapers, and rescue from fires.

Rather than supporting human beings in executing the foregoing tasks, another use of the legged mobile robots is to "live together" with human beings or to "entertain" human beings. This type of robot emulates the operation mechanism of a legged walking animal which has a relatively high intelligence, such as a human being, a dog, or a bear cub (pet), and the rich emotional expressions thereof. Instead of accurately executing operation patterns which are input in advance, this type of robot can make lively responsive expressions which are generated dynamically in accordance with the user's words and mood ("praising", "scolding", "hitting", etc).

In known toys, the relationship between the user operation and the response operation is fixed. The operation of the toy cannot be changed in accordance with the user's preferences. As a result, the user will become bored with a toy which only repeats the same operation.

In contrast, an intelligent robot has an action model and a learning model which depend on the operation thereof. In accordance with input information including external sounds, images, and tactile information, the models are changed, thus determining the operation. Accordingly, autonomous thinking and operation control can be realized. By preparing the robot with an emotion model and an instinct model, autonomous actions based on the robot's emotions and instincts can be exhibited. When the robot has an image input device and a speech input/output device, the robot can perform image recognition processing and speech recognition processing. Accordingly, the robot can perform realistic communication with a human being at a higher level of intelligence.

By changing the model in response to detection of an external stimulus including a user operation, that is, by adding a "learning model" having a learning effect, an action sequence which is not boring to the user or which is in accordance with each user's preferences can be performed.

Even without direct command input from an operator, a so-called autonomous robot can autonomously form an action plan taking into consideration external factors input by various sensors, such as a camera, a loudspeaker, and a touch sensor, and can perform the action plan through various mechanical output forms, such as the operation of limbs, speech output, etc.

When the action sequence is changed in accordance with the external factors, the robot takes an action which is surprising to and unexpected by the user. Thus, the user can continue to be together with the robot without getting bored.

While the robot is operating in cooperation with the user or another robot in a work space shared with the user, such as a general domestic space, the robot detects a change in the external factors, such as a change of time, a change of season, or a change in the user's mood and transforms the action sequence. Accordingly, the user can have a stronger affection for the robot.

DISCLOSURE OF INVENTION

It is an object of the present invention to provide a superior legged robot which can execute various action sequences utilizing limbs and/or a truck, an action control method for the legged robot, and a storage medium.

It is another object of the present invention to provide a superior legged robot of a type which can autonomously form an action plan in response to external factors without receiving direct command input from an operator and which can perform the action plan, an action control method for the legged robot, and a storage medium.

It is yet another object of the present invention to provide a superior legged robot which can detect external factors, such as a change of time, a change of season, a change in a user's mood, while operating in cooperation with a user in a work space shared with the user or another robot and which can transform an action sequence; an action control method for the legged robot; and a storage medium.

In view of the foregoing objects, according to a first aspect of the present invention, a legged robot which operates in accordance with a predetermined action sequence or an action control method for the legged robot is provided including:

input means or step for detecting an external factor;

option providing means or step for providing changeable options concerning at least a portion of the action sequence;

input determination means or step for selecting an appropriate option from among the options provided by the option providing means or step in accordance with the external factor detected by the input means or step; and action control means or step for performing the action sequence, which is changed in accordance with a determination result by the input determination means or step.

The legged robot according to the first aspect of the present invention performs an action sequence, such as reading aloud a story printed in a book or other print media or recorded in recording media or a story downloaded through a network. When reading a story aloud, the robot does not simply read every single word as it is written. Instead, the robot uses external factors, such as a change of time, a change of season, or a change in a user's mood, and dynamically alters the story as long as the changed contents are substantially the same as the original contents. As a result, the robot can read aloud the story whose contents would differ every time the story is read.

Since the legged robot according to the first aspect of the present invention can perform such unique actions, the user can be with the robot for a long period of time without getting bored. Also, the user can have a strong affection for the robot.

The world of the autonomous robot extends to the world of reading. Thus, the robot's understanding of the world can be enlarged.

The legged robot according to the first aspect of the present invention may include content obtaining means for obtaining external content for use in performing the action sequence. For example, content can be downloaded through information communication media, such as the Internet. Also, content can be transferred between two systems or greater through content storage media, such as a CD and a DVD. Alternatively, other content distribution media can be used.

The input means or step may detect an action applied by a user, such as "patting", as the external factor, or may detect a change of time or season or reaching a special date as the external factor.

The action sequence performed by the legged robot may be reading aloud a text supplied from a book or its equivalent, such as a printed material/reproduction, or a live performance of a comic story. Also, the action sequence may include playback of music data which can be used as BGM.

For example, in the action sequence, a scene to be read aloud may be changed in response to an instruction from a user, the instruction being detected by the input means or step.

The legged mobile robot may further include display means, such as eye lamps, for displaying a state. In such a case, the display means may change a display format in accordance with a change of scene to be read aloud.

According to a second aspect of the present invention, a robot apparatus with a movable section is provided including:

external factor detecting means for detecting an external factor;

speech output means for outputting a speech utterance by the robot apparatus;

storage means for storing a scenario concerning the contents of the speech utterance; and scenario changing means for changing the scenario, wherein the scenario is uttered by the speech output means while the scenario is changed by the scenario changing means in accordance with the external factor detected by the external factor detecting means.

The robot apparatus according to the second aspect of the present invention may actuate the movable section in accordance with the contents of the scenario when uttering the scenario.

The robot apparatus according to the second aspect of the present invention may perform speech output of the scenario concerning the contents of the speech utterance stored in advance. Instead of simply reading every single word as it is written, the robot apparatus can change the scenario using the scenario changing means in accordance with the external factor detected by the external factor detecting means.

Specifically, the scenario is dynamically changed using external factors, such as a change of time, a change of season, or a change in the user's mind, as long as the changed contents are substantially the same as the original contents. As a result, the contents to be uttered would differ every time the scenario is uttered. Since the robot apparatus according to the second aspect of the present invention can perform such unique actions, the user can be with the robot for a long period of time without getting bored. Also, the user can have a strong affection for the robot.

When uttering the scenario, the robot apparatus adds interaction, that is, actuating the movable section in accordance with the contents of the scenario. As a result, the scenario becomes more entertaining.

According to a third aspect of the present invention, there is provided a storage medium which has physically stored therein computer software in a computer-readable format, the computer software causing a computer system to execute action control of a legged robot which operates in accordance with a predetermined action sequence. The computer software includes:

an input step of detecting an external factor;

an option providing step of providing changeable options concerning at least a portion of the action sequence;

an input determination step of selecting an appropriate option from among the options provided in the option providing step in accordance with the external factor detected in the input step; and an action control step of performing the action sequence, which is changed in accordance with a determination result in the input determination step.

The storage medium according to the third aspect of the present invention provides, for example, computer software in a computer-readable format to a general computer system which can execute various program code. Such a medium includes, for example, a removable, portable storage medium, such as a CD (Compact Disc), an FD (Floppy Disk), and an MO (Magneto-Optical disc). Alternatively, it is technically possible to provide the computer software to a specific computer system through a transmission medium, such as a network (without distinction between wireless networks and wired networks). Needless to say, the intelligent legged mobile robot has a high information processing capacity and has an aspect as a computer.

The storage medium according to the third aspect of the present invention defines the structural or functional cooperative relationship between predetermined computer software and a storage medium for causing a computer system to perform functions of the computer software. In other words, by installing predetermined computer software into a computer system through the storage medium according to the third aspect of the present invention, the cooperative operation can be performed by the computer system. Thus, the operation and advantages similar to those of the legged mobile robot and the action control method for the legged mobile robot according to the first aspect of the present invention can be achieved.

According to a fourth aspect of the present invention, a recording medium is provided including a text to be uttered by a robot apparatus; and identification means for enabling the robot apparatus to recognize an utterance position in the text when the robot apparatus utters the text.

The recording medium according to the fourth aspect of the present invention is formed as, for example, a book formed by binding a printed medium containing a plurality of pages at an edge thereof so that the printed medium can be opened and closed. When reading aloud a text in such a recording medium while looking at it, the robot apparatus can detect an appropriate portion to read aloud with the assistance of the identification means for enabling the robot apparatus to recognize the utterance position.

As the identification means, for example, the left and right pages when a book is opened are in different colors (that is, printing or image formation processing is performed so that the combination of colors differs for each page). Alternatively, a visual marker, such as a cybercode, can be pasted to each page. Accordingly, the identification means can be realized.

Further objects, features, and advantages of the present invention will become apparent from the following description of the embodiments of the present invention with reference to the attached drawings.

BRIEF DESCRIPTION OF THE DRAWINGS

FIGS. 12 to 17 illustrate examples of stories of scenes 1 to 6, respectively.

BEST MODES FOR CARRYING OUT THE INVENTION

Embodiments of the present invention will now be described in detail with reference to the drawings.

Figure 1:
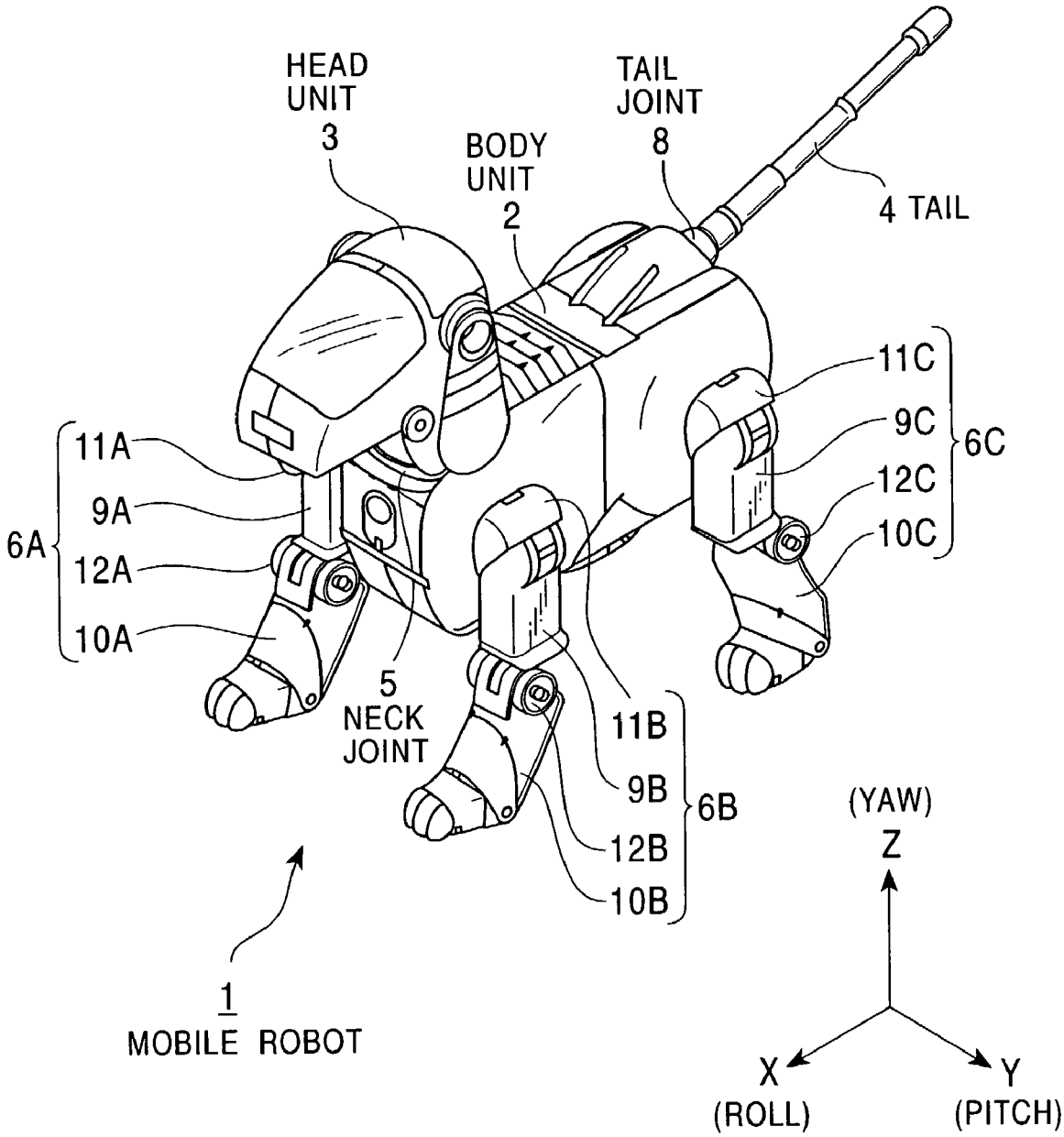
FIG. 1 shows the external configuration of a mobile robot 1, according to an embodiment of the present invention, which performs legged walking using four limbs.

In FIG. 1, according to an embodiment of the present invention, the external configuration of a mobile robot 1 which performs legged walking using four limbs is shown. As shown in the drawing, the robot 1 is a polyarticular mobile robot which is modeled after the shape and the structure of a four-legged animal. In particular, the mobile robot 1 of this embodiment is a pet robot which is designed after the shape and the structure of a dog, which is a typical example of a pet animal. For example, the mobile robot 1 can live together with a human being in a human living environment and can perform actions in response to user operations.

The mobile robot 1 contains a body unit 2, a head unit 3, a tail 4, and four limbs, that is, leg units 6A to 6D.

The head unit 3 is arranged on a substantially front top end of the body unit 2 through a neck joint 7 which has degrees of freedom in each axial direction, namely, roll, pitch, and yaw (shown in the drawing). The head unit 3 also includes a CCD (Charge Coupled Device) camera 15, which corresponds to the "eyes" of the dog, a microphone 16, which corresponds to the "ears", a loudspeaker 17, which corresponds to the "mouth", a touch sensor 18, which is arranged at a location such as on the head or the back and which senses the user's touch, and a plurality of LED indicators (eye lamps) 19. Apart from these components, the robot 1 may have sensors forming the senses of a living thing.

In accordance with a display state, the eye lamps 19 feed back to a user information concerning the internal state of the mobile robot 1 and an action sequence being executed. The operation will be described hereinafter.

The tail 4 is arranged on a substantially rear top end of the body unit 2 through a tail joint 8, which has degrees of freedom along the roll and pitch axes, so that the tail 4 can bend or swing freely.

The leg units 6A and 6B form front legs, and the leg units 6C and 6D form back legs. The leg units 6A to 6D are formed by combinations of thigh units 9A to 9D and calf units 10A to 10D, respectively. The leg units 6A to 6D are arranged at front, back, left, and right corners of the bottom surface of the body unit 2. The thigh units 9A to 9D are connected at predetermined locations of the body unit 2 by hip joints 11A to 11D, which have degrees of freedom along the roll, pitch, and yaw axes. The thigh units 9A to 9D and the calf units 10A to 10D are interconnected by knee joints 12A to 12D, which have degrees of freedom along the roll and pitch axes.

Figure 11:
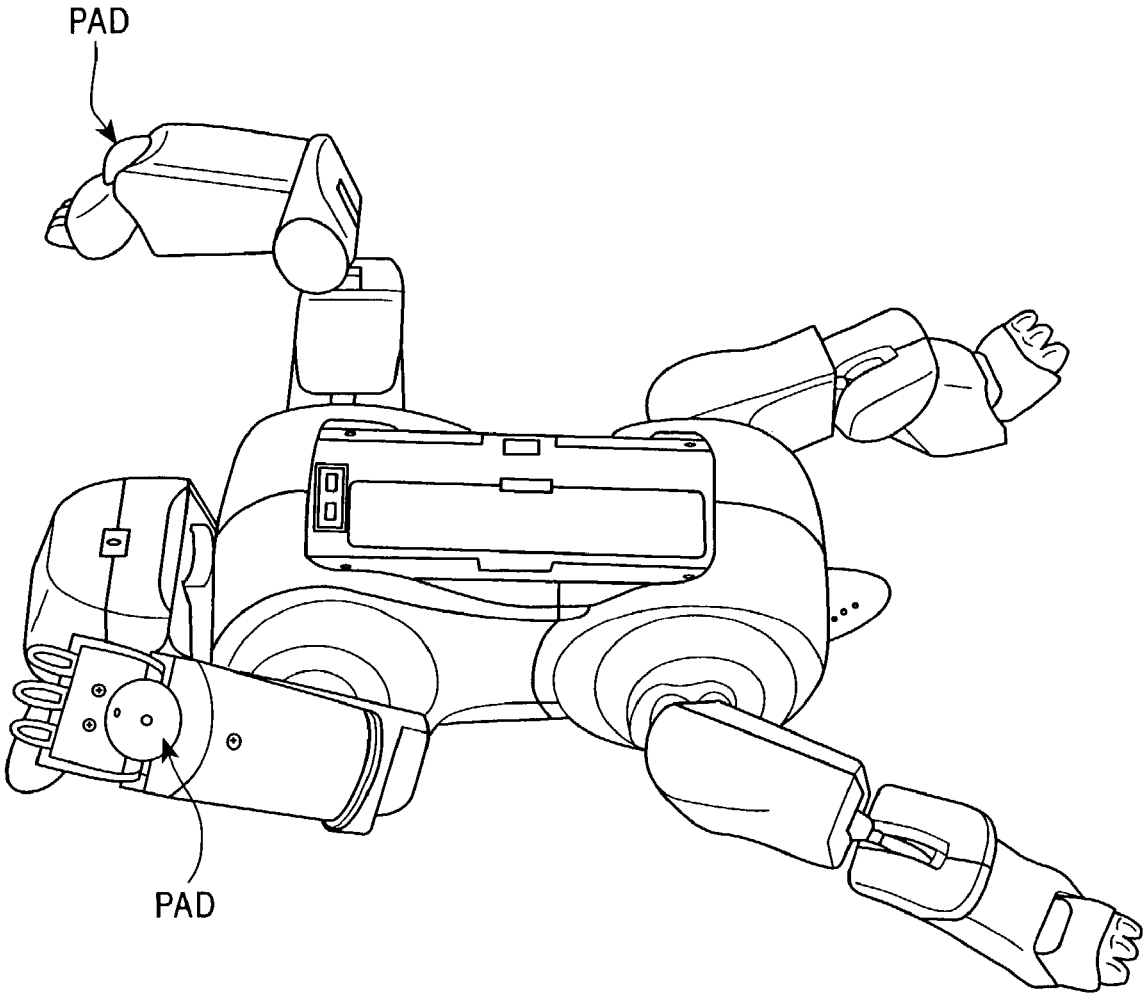
FIG. 11 shows pad switches arranged on the soles.

In FIG. 11, the mobile robot is shown viewed from the bottom surface. As shown in the drawing, pads are attached to the soles of four limbs. These pads are formed as switches which can be pressed. Along with the camera 15, the loudspeaker 17, and the touch sensor 18, the pads are important input means for detecting a user command and changes in the external environment.

By driving each joint actuator in response to a command from a controller described below, the mobile robot 1 arranged as described above moves the head unit 3 vertically and horizontally, moves the tail 4, and drives the leg units 6A to 6D in synchronization and in cooperation, thereby realizing an operation such as walking and running.

The degrees of freedom of the joints of the mobile robot 1 are provided by rotational driving of joint actuators (not shown), which are arranged along each axis. The number of degrees of freedom of the joints of the legged mobile robot 1 is arbitrary and does not limit the scope of the present invention.

Figure 2:
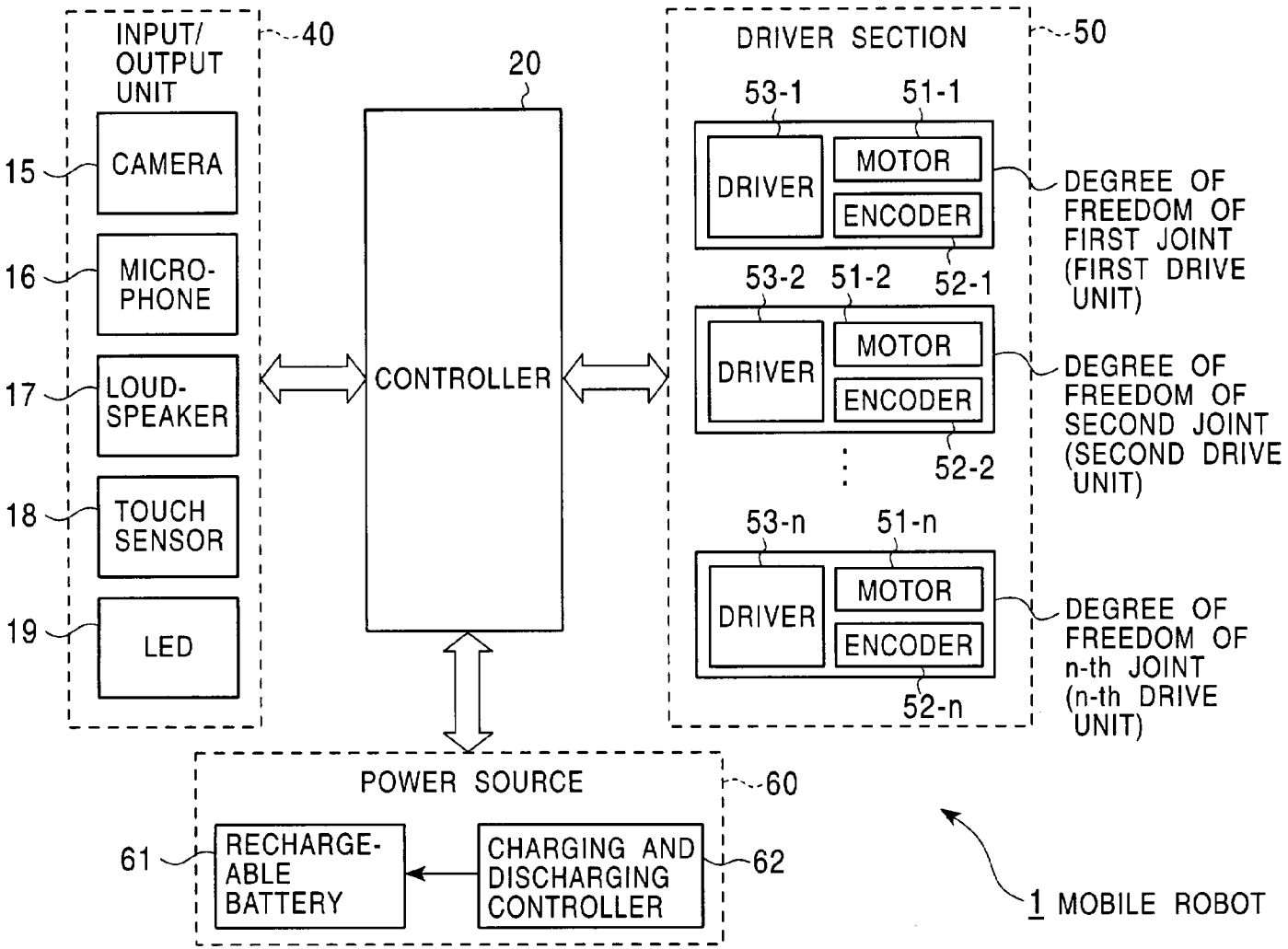
FIG. 2 is a block diagram which schematically shows an electrical control system of the mobile robot 1.

In FIG. 2, a block diagram of an electrical control system of the mobile robot 1 is schematically shown. As shown in the drawing, the mobile robot 1 includes a controller 20 for controlling the overall operation and performing other data processing, an input/output unit 40, a driver section 50, and a power source 60. Each component will now be described below.

As input units, the input/output unit 40 includes the CCD camera 15, which corresponds to the eyes of the mobile robot 1, the microphone 16, which corresponds to the ears, the touch sensor 18, which is arranged at a predetermined location, such as on the head or the back, and which senses user's touch, the pad switches, which are arranged on the soles, and various other sensors corresponding to the senses. As output units, the input/output unit 40 includes the loudspeaker 17, which corresponds to the mouth, and the LED indicators (eye lamps) 19, which generate facial expressions using combinations of flashing and illumination of the LED indicators at specific times. These output units can represent user feedback from the mobile robot 1 in formats other than mechanical motion patterns using the legs or the like.

Since the mobile robot 1 includes the camera 15, the mobile robot 1 can recognize the shape and color of an arbitrary object in the work space. In addition to visual means including the camera, the mobile robot 1 can contain a receiver for receiving transmitted waves, such as infrared rays, sound waves, ultrasonic waves, and electromagnetic waves. In this case, the position and the direction from the transmitting source can be measured in accordance with the output of each sensor for sensing the corresponding transmission wave.

The driver section 50 is a functional block for implementing mechanical motion of the mobile robot 1 in accordance with a predetermined motion pattern instructed by the controller 20. The driver section 50 is formed by drive units provided for each axis, namely, roll, pitch, and yaw, at each of the neck joint 7, the tail joint 8, the hip joints 11A to 11D, and the knee joints 12A and 12D. In an example shown in the drawing, the mobile robot 1 has n joints with the corresponding degrees of freedom. Thus, the driver section 50 is formed by n drive units. Each drive unit is formed by a motor 51 which rotates in a predetermined axial direction, an encoder 52 for detecting the rotational position of the motor 51, and a driver 53 for appropriately controlling the rotational position and the rotational speed of the motor 51 in accordance with the output of the encoder 52.

Literally speaking, the power source 60 is a functional module for feeding power to each electrical circuit in the mobile robot 1. The mobile robot 1 according to this embodiment is an autonomous driving-type using a battery. The power source 60 is formed by a rechargeable battery 61 and a charging and discharging controller 62 for controlling the charging and discharging state of the rechargeable battery 61.

The rechargeable battery 61 is formed as a "battery pack", which is formed by packaging a plurality of nickel cadmium battery cells in a cartridge.

The charging and discharging controller 62 detects the remaining capacity of the battery 61 by measuring the terminal voltage across the battery 61, the charging/discharging current, and the ambient temperature of the battery 61 and determines the charge start time and end time. The charge start and end time determined by the charging and discharging controller 62 are sent to the controller 20, and this triggers the mobile robot 1 to start and end the charging operation.

The controller 20 corresponds to a "brain" and is provided in the head unit 3 or the body unit 2 of the mobile robot 1.

Figure 3:
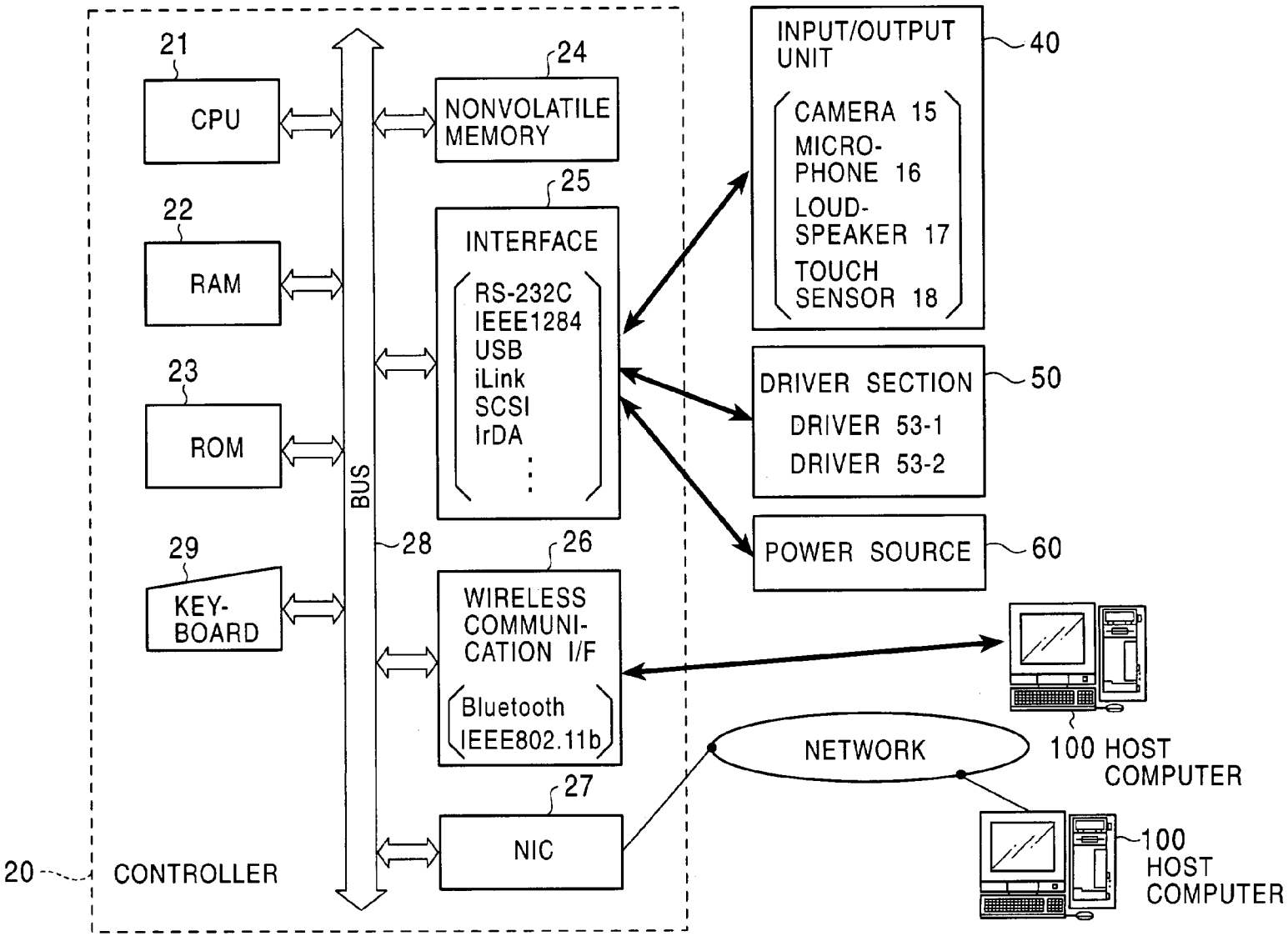
FIG. 3 shows the detailed configuration of a controller 20.

In FIG. 3, the configuration of the controller 20 is shown in further detail. As shown in the drawing, the controller 20 is formed of a CPU (Central Processing Unit) 21, functioning as a main controller, which is interconnected with a memory, other circuit components, and peripheral devices by a bus. A bus 27 is a common signal transmission line including a data bus, an address bus, and a control bus. A unique address (memory address or I/O address) is assigned to each device on the bus 27. By specifying the address, the CPU 21 can communicate with a specific device on the bus 28.

A RAM (Random Access Memory) 22 is a writable memory formed by a volatile memory, such as a DRAM (Dynamic RAM). The RAM 22 loads program code to be executed by the CPU 21 and temporarily stores working data used by the executed program.

A ROM (Read Only Memory) 23 is a read only memory for permanently storing programs and data. Program code stored in the ROM 23 includes a self-diagnosis test program executed when the mobile robot 1 is turned on and an operation control program for defining the operation of the mobile robot 1.

Control programs for the robot 1 include a "sensor input processing program" for processing sensor input from the camera 15 and the microphone 16, an "action command program" for generating an action, that is, a motion pattern, of the mobile robot 1 in accordance with the sensor input and a predetermined operation model, a "drive control program" for controlling driving of each motor and speech output of the loudspeaker 17 in accordance with the generated motion pattern, and an application program for offering various services.

Besides normal walking and normal running, the motion pattern generated by the drive control program can include entertaining operations, such as "shaking a paw", "leaving it", "sitting", and barking such as "bow-wow".

The application program is a program which offers a service including an action sequence for reading a book aloud, giving a live Rakugo (comic story) performance, and playing music in accordance with external factors.

The sensor input processing program and the drive control program are hardware-dependent software layers. Since program code is unique to the hardware configuration of the body, the program code is generally stored in the ROM 23 and is integrated and provided with the hardware. In contrast, the application software such as an action sequence is a hardware-independent layer, and hence the application software need not be integrated and provided with the hardware. In addition to a case where the application software is stored in advance in the ROM 23 and the ROM 23 is provided in the body, the application software can be dynamically installed from a storage medium, such as a memory stick, or can be downloaded from a server on a network.

As in an EEPROM (Electrically Erasable and Programmable ROM), a non-volatile memory 24 is formed as a memory device which is electrically erasable/writable and is used to store data to be sequentially updated in a non-volatile manner. Data to be sequentially updated includes, for example, security information including a serial number or a cryptographic key, various models defining the action patterns of the mobile robot 1, and program code.

An interface 25 interconnects with external devices outside the controller 20, and hence data can be exchanged with these devices. The interface 25 inputs/outputs data from/to, for example, the camera 15, the microphone 16, and the loudspeaker 17. The interface 25 also inputs/outputs data and commands from/to each driver 53-1 . . . in the driver section 50.

The interface 25 includes general interfaces with computer peripheral devices. Specifically, the general interfaces include a serial interface such as RS (Recommended Standard)-232C, a parallel interface such as IEEE (Institute of Electrical and electronics Engineers) 1284, a USB (Universal Serial Bus) interface, an i-Link (IEEE 1394) interface, an SCSI (Small Computer System Interface) interface, and a memory card interface (card slot) which receives a memory stick. The interface 25 may exchange programs and data with locally-connected external devices.

As another example of the interface 25, an infrared communication (IrDA) interface can be provided, and hence wireless communication with external devices can be performed.

The controller 20 further includes a wireless communication interface 26 and a network interface card (NIC) 27 and performs short-range wireless data communication such as "Bluetooth" and data communication with various external host computers 100 via a wireless network such as "IEEE.802.11b" or a wide-area network (WAN) such as the Internet.

One purpose of data communication between the mobile robot 1 and each host computer 100 is to compute complicated operation control of the mobile robot 1 using (remote) computer resources outside the robot 1 and to perform remote control of the mobile robot 1.

Another purpose of the data communication is to supply data/content and program code, such as the action model and other program code, which are required for controlling the operation of the robot 1 from a remote apparatus via a network to the mobile robot 1.

The controller 20 may include a keyboard 29 formed by a numeric keypad and/or alphabet keys. In the work space of the robot 1, the keyboard 29 is used by the user to directly input a command and to input owner authentication information such as a password.

The mobile robot 1 according to this embodiment can operate autonomously (that is, without requiring people's help) by executing, in the controller 20, a predetermined operation control program. The mobile robot 1 contains input devices corresponding to the senses of a human being or an animal, such as an image input device (which is the camera 15), a speech input device (which is the microphone 16), and the touch sensor 18. Also the mobile robot 1 has the intelligence to execute a rational or an emotional action in response to external input.

The mobile robot 1 arranged as shown in FIGS. 1 to 3 has the following characteristics. Specifically:

(1) When the mobile robot 1 is instructed to change from a first posture to a second posture, instead of directly changing from the first posture to the second posture, the mobile robot 1 can smoothly change from the first posture to the second posture through an intermediate position which is prepared in advance;

(2) When the mobile robot 1 reaches an arbitrary posture while changing posture, the mobile robot 1 can receive a notification;

(3) The mobile robot 1 can perform posture control while independently controlling the position of each unit, such as the head, the legs, and the tail. In other words, in addition to controlling the overall posture of the robot 1, the position of each unit can be controlled; and (4) The mobile robot 1 can receive parameters showing the detailed operation of an operation command.

Figure 4:
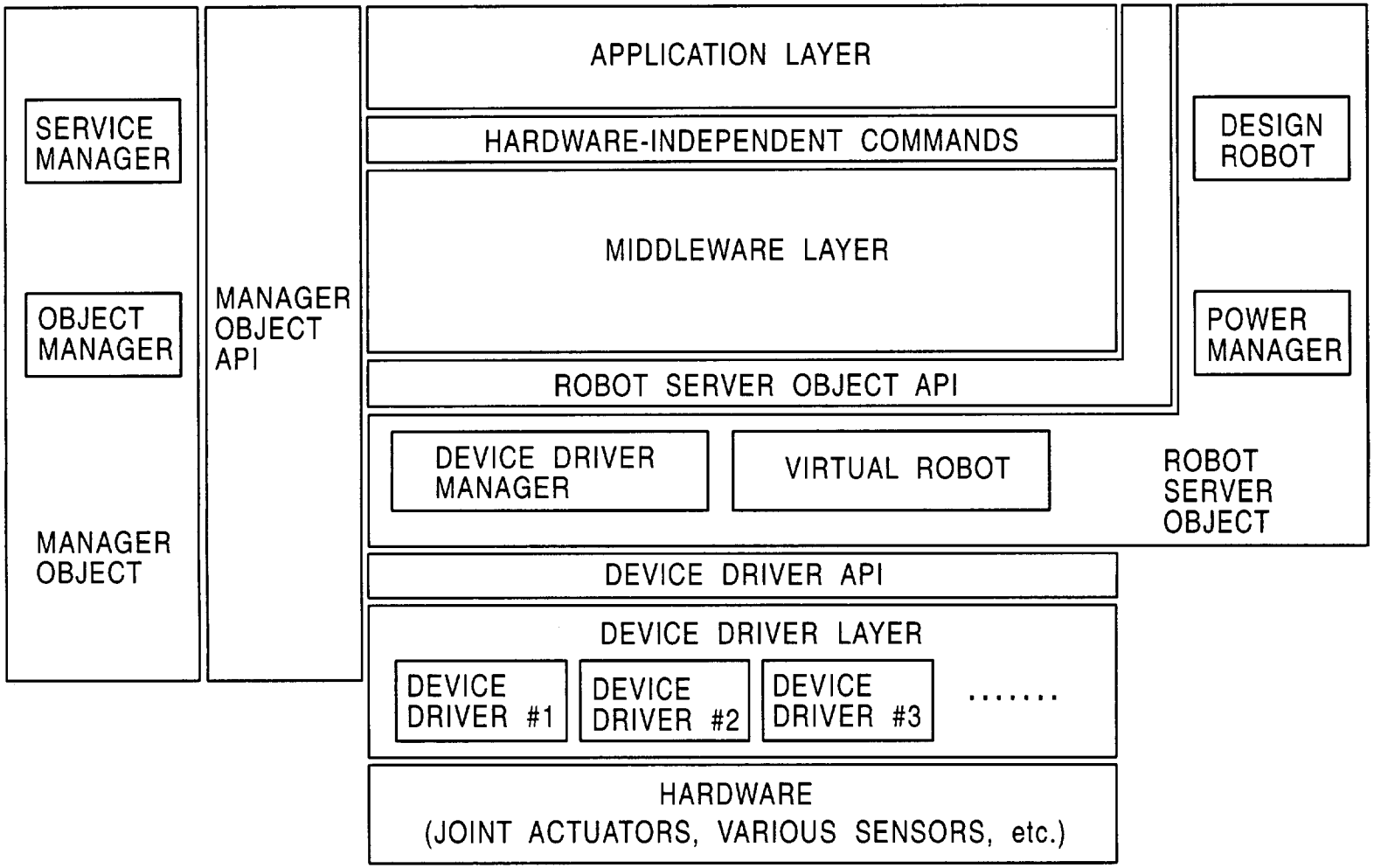
FIG. 4 schematically shows the software control configuration operating on the mobile robot 1.

The operation control of the mobile robot 1 is effectively performed by executing a predetermined software program in the CPU 21. In FIG. 4, the software control configuration running on the mobile robot 1 is schematically shown.

As shown in the drawing, the robot control software has a hierarchical structure formed by a plurality of software layers. The control software can employ object-oriented programming. In this case, each piece of software is treated as a modular unit, each module being an "object" integrating data and processing of the data.

A device driver in the bottom layer is an object permitted to gain direct access to the hardware, such as to drive each joint actuator and to receive a sensor output. The device driver performs corresponding processing in response to an interrupt request from the hardware.

A virtual robot is an object which acts as an intermediary between various device drivers and an object operating in accordance with a predetermined inter-object communication protocol. Access to each hardware item forming the robot 1 is gained through the virtual robot.

A service manager is a system object which prompts each object to establish connection based on inter-object connection information described in a connection file.

Software above a system layer is modularized according to each object (process). An object is selected according to each function required. Thus, replacement can be performed easily. By rewriting the connection file, input/output of objects of the same data type can be freely connected.

Software modules other than the device driver layer and the system layer are broadly divided into a middleware layer and an application layer.

Figure 5:
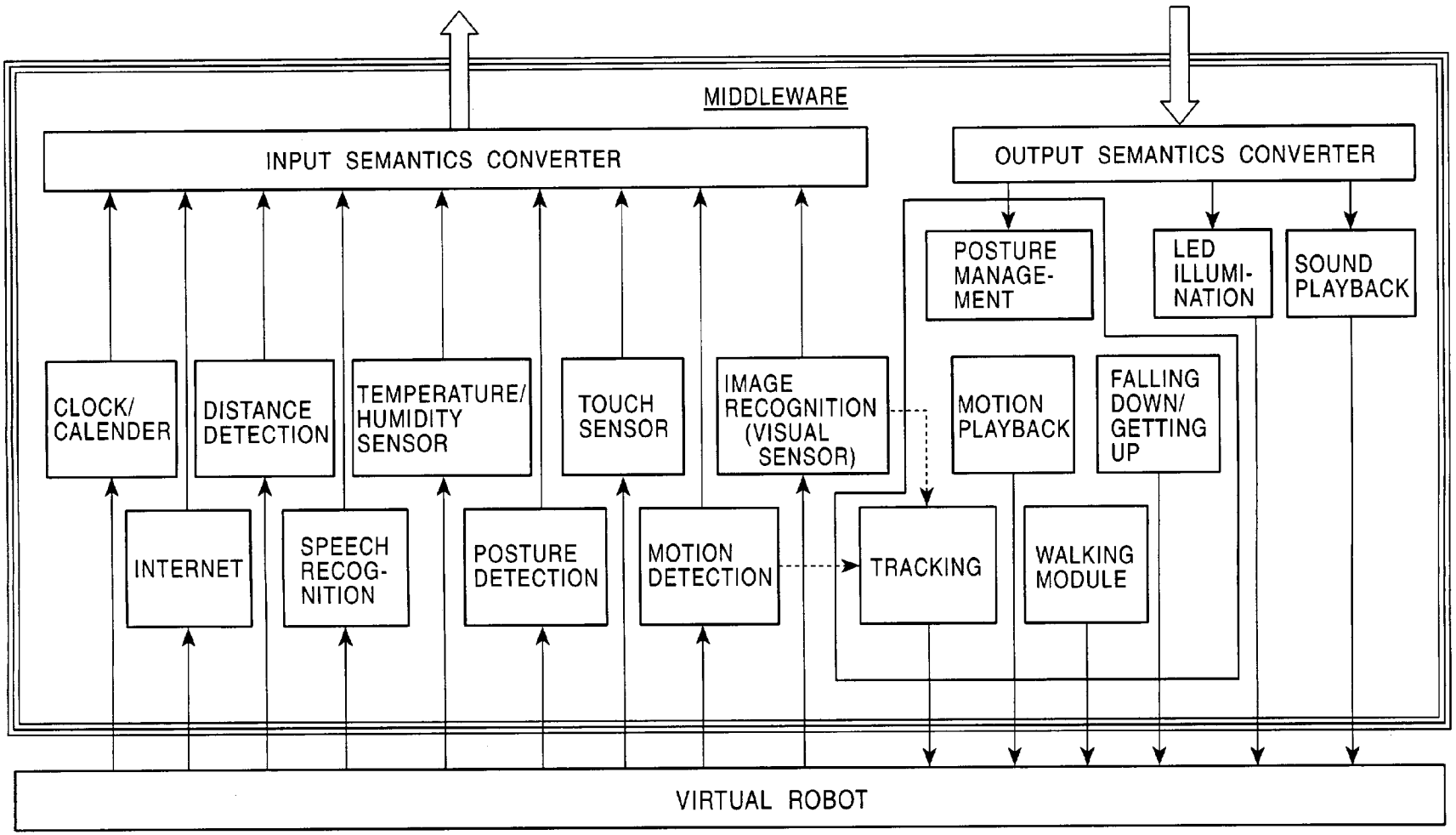
FIG. 5 schematically shows the internal configuration of a middleware layer.

In FIG. 5, the internal configuration of the middleware layer is schematically illustrated.

The middleware layer is a collection of software modules which provide the basic functions of the robot 1. The configuration of each module is influenced by hardware attributes, such as mechanical/electrical characteristics, specifications, and the shape of the robot 1.

The middleware layer can be functionally divided into recognition-system middleware (the left half of FIG. 5) and output-system middleware (the right half of FIG. 5).

In the recognition-system middleware, raw data from the hardware, such as image data, audio data, and detection data obtained from the touch sensor 18, the pad switches, or other sensors, is received through the virtual robot and is processed. Specifically, processing such as speech recognition, distance detection, posture detection, contact, motion detection, and image recognition is performed in accordance with various pieces of input information, and recognition results are obtained (for example, a ball is detected; falling down is detected; the robot 1 is patted; the robot 1 is hit; a C-E-G chord is heard; a moving object is detected; something is hot/cold (or the weather is hot/cold); it is refreshing/humid; an obstacle is detected; an obstacle is recognized; etc.). The recognition results are sent to the upper application layer through an input semantics converter and are used to form an action plan. In this embodiment, in addition to the sensor information, information downloaded through WAN, such as the Internet, and the actual time indicated by a clock or a calendar is employed as input information.

In contrast, the output-system middleware provides functions such as walking, reproducing motion, synthesizing an output sound, and illumination control of the LEDs corresponding to the eyes. Specifically, the action plan formed by the application layer is received and processed through an output semantics converter. According to each function of the robot 1, a servo command value for each joint, an output sound, output light (eye lamps formed by a plurality of LEDs), and output speech are generated, and they are output, that is, performed by the robot 1 through the virtual robot. As a result of such a mechanism, the operation performed by each joint of the robot 1 can be controlled by giving a more abstract command (such as moving forward or backward, being pleased, barking, sleeping, exercising, being surprised, tracking, etc.).

Figure 6:
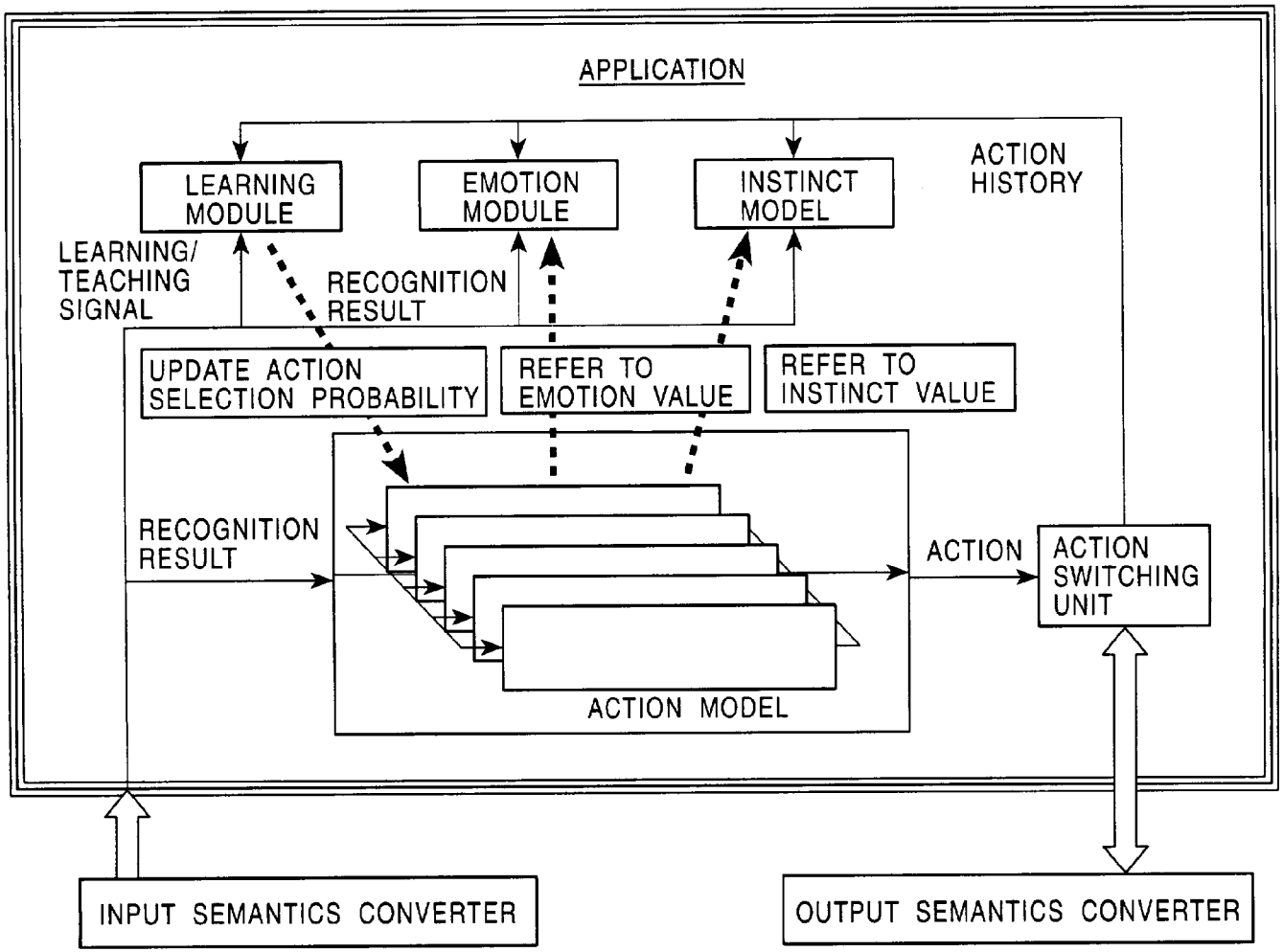
FIG. 6 schematically shows the internal configuration of an application layer.

In FIG. 6, the internal configuration of the application layer is schematically illustrated.

The application uses the recognition results, which are received through the input semantics converter, to determine an action plan for the robot 1 and returns the determined action plan through the output semantics converter.

The application includes an emotion model which models the emotions of the robot 1, an instinct model which models the instincts of the robot 1, a learning module which sequentially stores the causal relationship between external events and actions taken by the robot 1, an action model which models action patterns, and an action switching unit which switches an action output destination determined by the action model.

The recognition results input through the input semantics converter are input to the emotion model, the instinct model, and the action model. Also, the recognition results are input as learning/teaching signals to the learning module.

The action of the robot 1, which is determined by the action model, is transmitted to the action switching unit and to the middleware through the output semantics converter and is executed on the robot 1. Alternatively, the action is supplied through the action switching unit as an action history to the emotion model, the instinct model, and the learning module.

The emotion model and the instinct model receive the recognition results and the action history and manages an emotion value and an instinct value. The action model can refer to the emotion value and the instinct value. The learning module updates an action selection probability in accordance with the learning/teaching signal and supplies the updated contents to the action model.

The learning module according to this embodiment can associate time-series data, such as music data, with joint angle parameters and can learn the associated time-series data and the joint angle parameters as time-series data. A neural network can be employed to learn the time-series data. For example, the specification of Japanese Patent Application 2000-252483, which has been assigned to the applicant of the present invention, discloses a learning system of a robot using a recurrent neural network.

The robot, which has the foregoing control software configuration, includes the action model and the learning model which depend on the operation thereof. By changing the models in accordance with input information, such as external speech, images, and contact, and by determining the operation, autonomous thinking and operation control can be realized. Since the robot is prepared with the emotion model and the instinct model, the robot can exhibit autonomous actions based on the robot's own emotions and instincts. Since the robot 1 has the image input device and the speech input device and performs image recognition processing and speech recognition processing, the robot can perform realistic communication with a human being at a higher level of intelligence.

Even without direct command input from an operator, the so-called autonomous robot can obtain external factors from inputs of various sensors, such as the camera, the loudspeaker, and the touch sensor, autonomously form an action plan, and performs the action plan through various output forms such as the movement of limbs and the speech output. By changing the action sequence in accordance with the external factors, the robot takes an action which is surprising to and unexpected by the user. Thus, the user can continue to be with the robot without getting bored.

Hereinafter, a process of transforming, by the autonomous robot, an action sequence in accordance with external factors will be described by illustrating a case where the robot executes the action sequence in which the robot "reads aloud" a book.

Figure 7:
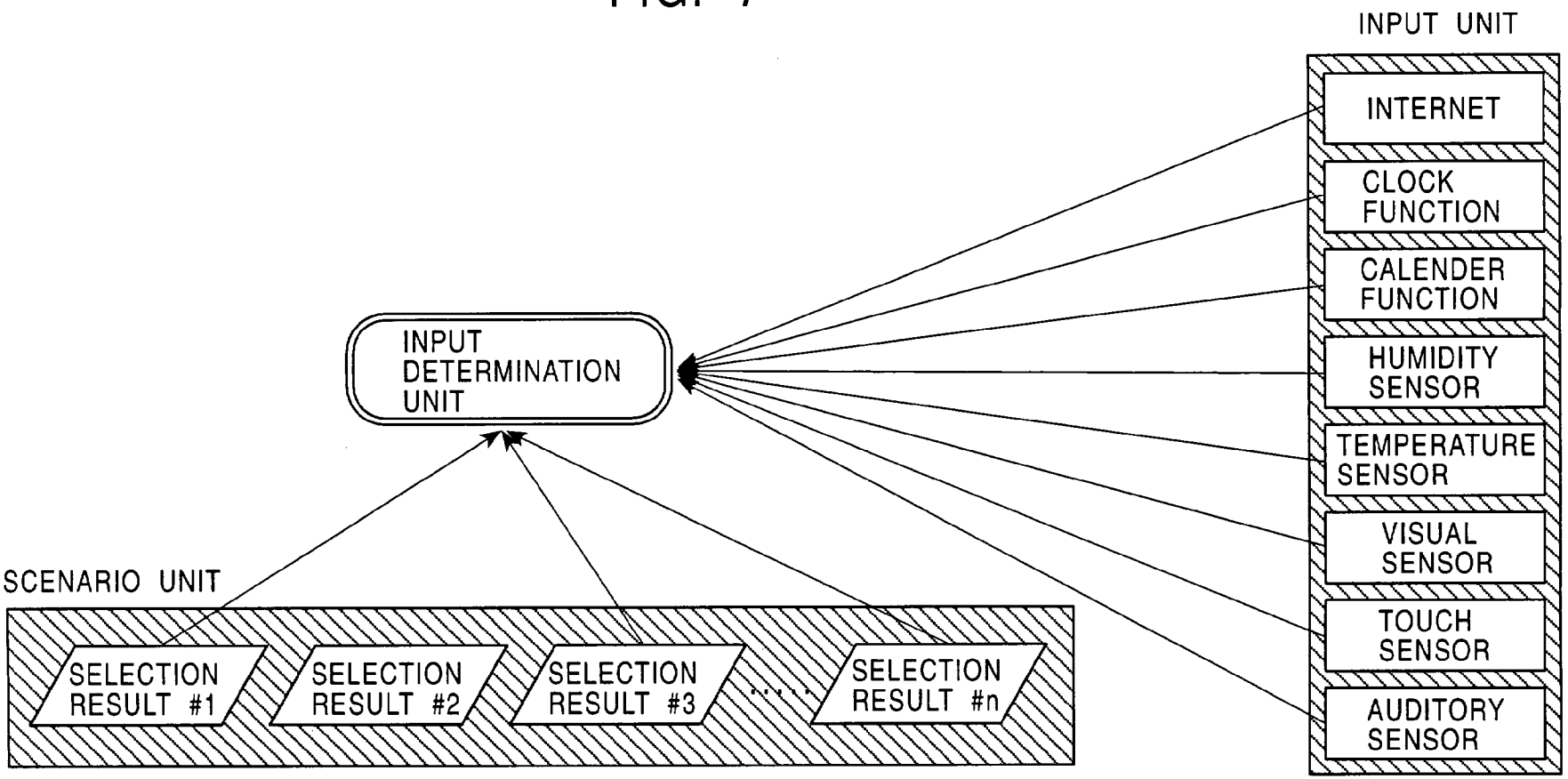
FIG. 7 is a block diagram which schematically shows the functional configuration for transforming an action sequence.

In FIG. 7, the functional configuration for transforming the action sequence is schematically illustrated.

As shown in the drawing, transformation of the action sequence is performed by an input unit for inputting external factors, a scenario unit for providing scenario options forming the action sequence, and an input determination unit for selecting an option from the scenario unit in accordance with the input result.

The input unit is formed by, for example, an auditory sensor (such as a microphone), a touch sensor, a visual sensor (such as a CCD camera), a temperature sensor, a humidity sensor, a pad switch, a current-time timer such as a calendar function and a clock function, and a receiver for receiving data distributed from an external network, such as the Internet. The input unit is formed by, for example, recognition-system middleware. Detection data-obtained from the sensors is received through the virtual robot, and predetermined recognition processing is performed. Subsequently, the detection data is transferred to the input determination unit.

The input determination unit determines external factors in the work space where the robot is currently located in accordance with a message received from the input unit. In accordance with the determination result, the input determination unit dynamically transforms the action sequence, that is, the story of the book to be read aloud. The scenario forming the transformed contents to be read aloud can only be changed as long as the transformed contents are substantially the same as the original contents, because changing the story of the book itself no longer means "reading aloud" the book.

The scenario unit offers scenario options corresponding to external factors. Although each option is generated by modifying or changing the original text, that is, the original scenario, in accordance with external factors, the changed contents have substantially the same meaning as the original contents. In accordance with a message from the input unit, the input determination unit selects one from a plurality of selection results offered by the scenario unit and performs the selected result, that is, reads the selected result aloud.

The changed contents based on the determination result are assured to have the same meaning as the original story as long as they are offered by the scenario unit. When viewed from the user side, the story whose meaning is preserved is presented in a different manner in accordance with the external factors. Even when the same story is read aloud to the user many times, the user can always listen to the story with a fresh sense. Thus, the user can be with the robot for a long period of time without getting bored.

Figure 8:
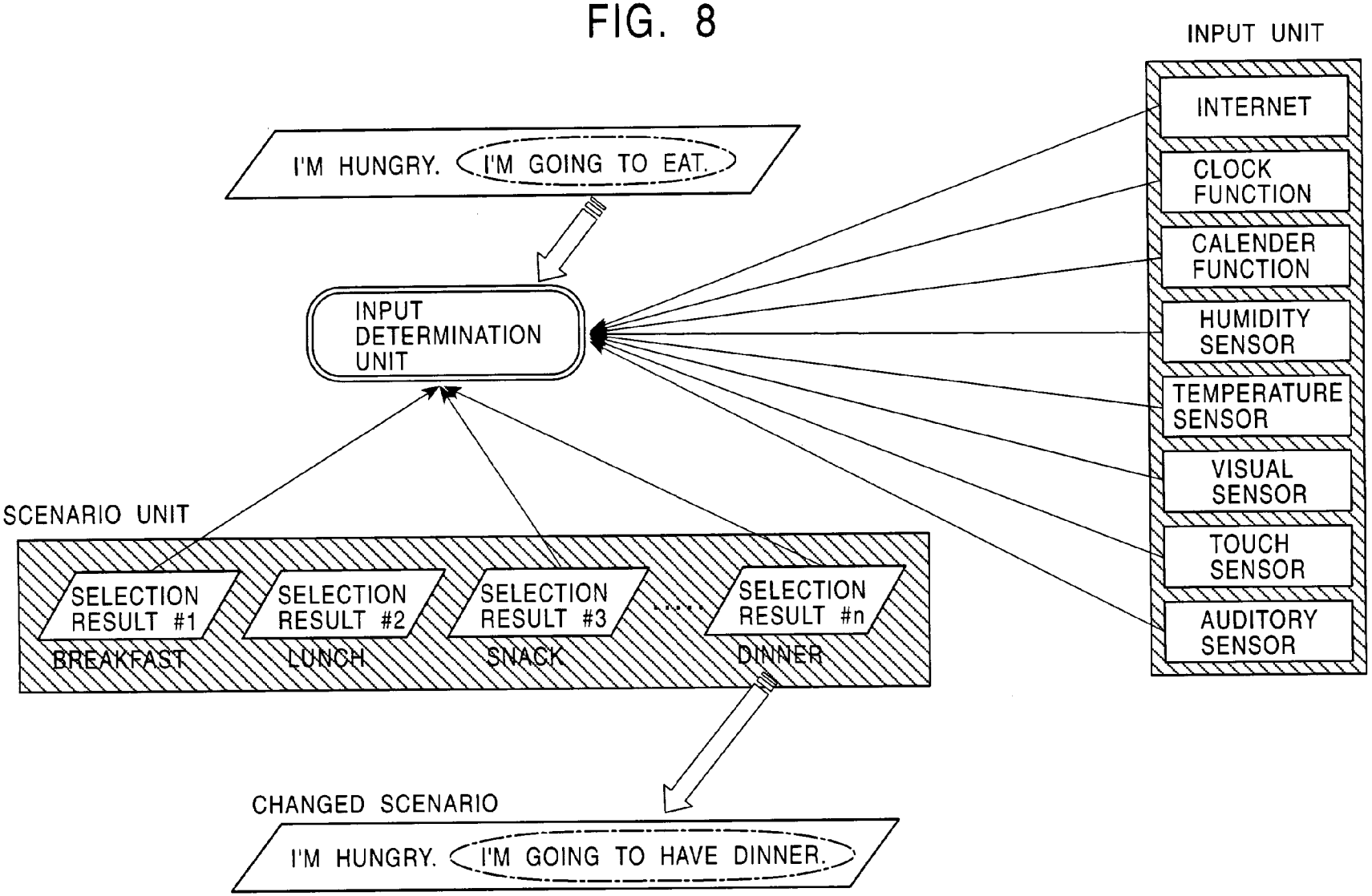
FIG. 8 shows the functional configuration in which the script "I'm hungry. I'm going to eat" from an original scenario is changed in accordance with external factors.

FIG. 8 illustrates that, in the functional configuration shown in FIG. 7, the script "I'm hungry. I'm going to eat." from the original scenario is changed in accordance with external factors.

As shown in the drawing, of the original scenario, the script "I'm hungry. I'm going to eat.", which is permitted to be transformed in accordance with external factors, is input to the input determination unit.

The input determination unit is always aware of the current external factors in accordance with the input message from the input unit. In an example shown in the drawing, for example, the input determination unit is informed of the fact that it is evening based on the input message from the clock function.

In response to the script input, the input determination unit executes semantic interpretation and detects that the input script is related to "meals". The input determination unit refers to the scenario unit and selects the optimal scenario from branchable options concerning "meals". In the example shown in the drawing, the selection result indicating "dinner" is returned to the input determination unit in response to the time setting indicating "evening".

The input determination unit transforms the original script in accordance with the selection result as a returned value. In the example shown in the drawing, the original script "I'm hungry. I'm going to eat." is replaced by the script "I'm hungry. I'm going to have dinner," which is modified in accordance with external factors.

The new script replacing the old script is transferred to the middleware through the output semantics and executed in the form of reading by the robot through the virtual robot.

When the autonomous robot reads a book (story) aloud, the robot does not read the book exactly as it is written. Instead, using various external factors, the robot dynamically alters the story and tells the story so that, every time the story is told, the contents would differ as long as the story is not greatly changed. It is thus possible to provide a unique, autonomous robot.

The elements of a story include, for example, scripts of characters, stage directions, and other text. These elements of a story can be divided into elements which do not influence the meaning of the entire story when modified/changed/replaced in accordance with external factors (for example, elements within the allowable range of ad lib even when modified/changed) and elements which cause the meaning of the story to be changed when modified/changed.

Figure 9:
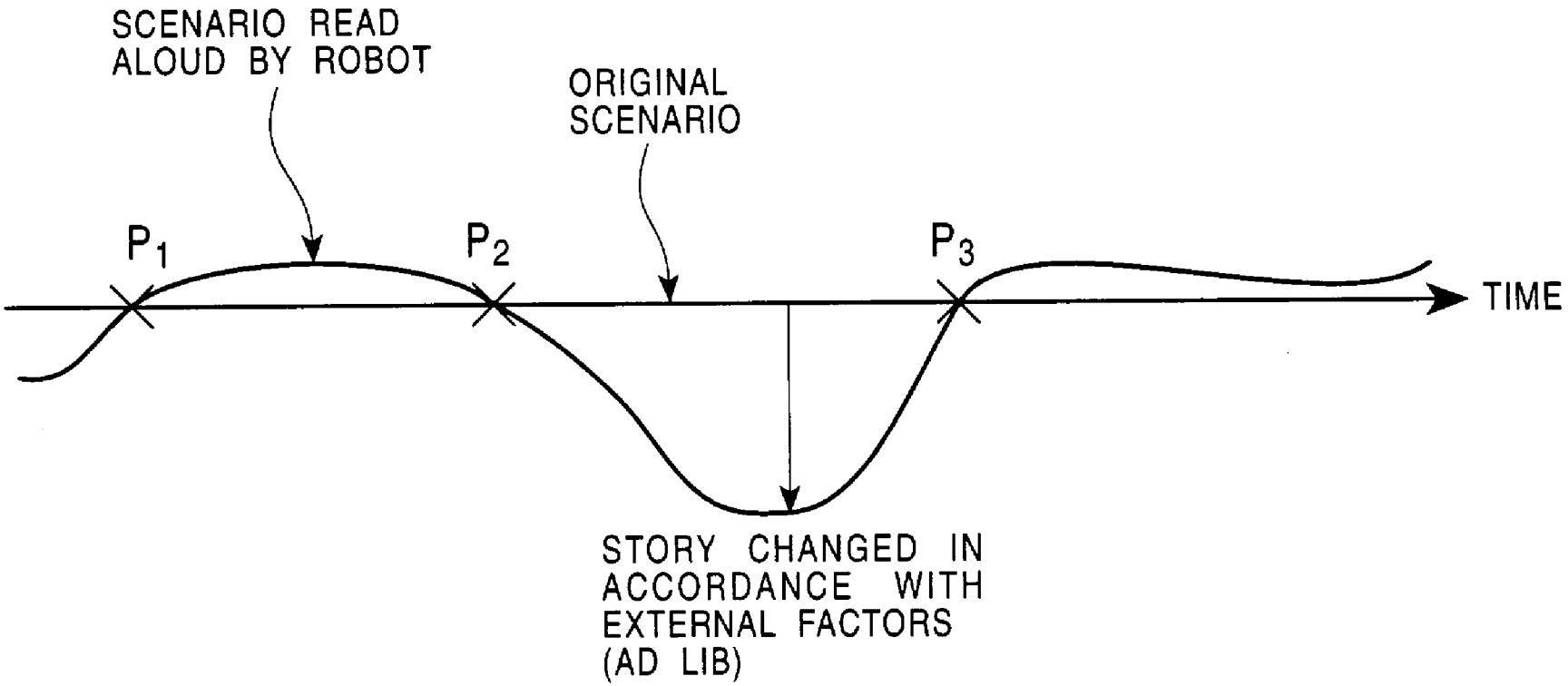
FIG. 9 schematically shows how the story is changed in accordance with external factors.

FIG. 9 schematically illustrates how the story is changed in accordance with external factors.

The story itself can be regarded as time-series data whose state changes as time passes (that is, the development of the story). Specifically, the elements including scripts, stage directions, and other text to be read aloud are arranged along the time axis.

The horizontal axis of FIG. 9 is the time axis. Points $P_1$, $P_2$, $P_3$, . . . on the time axis indicate elements which are not permitted to be changed in accordance with external factors. (In other words, the meaning of the story is changed when these elements are changed.) These elements are incapable of branching in accordance with external factors. In the first place, the scenario unit shown in FIG. 7 does not prepare options for these elements.

In contrast, regions other than the points $P_1$, $P_2$, $P_3$, . . . on the time axis include elements which are permitted to be changed in accordance with external factors. The meaning of the story is not changed even when these elements are changed in accordance with external factors, such as the season, the time, and the user's mood. Specifically, these elements are capable of branching in accordance with external factors. It is preferable that the scenario unit prepare a plurality of options, that is, candidate values.

In FIG. 9, points away from the time axis are points changed from the original text in accordance with external factors. The user, who will be the listener, can recognize these points as, for example, ad lib. Thus, the meaning of the story is not changed. Specifically, since the robot according to the embodiment of the present invention can read the book aloud while dynamically changing the story in accordance with external factors, the robot can tell a story which differs slightly every time it is told to the user. Needles to say, the story at points at which elements are changed from the original text in accordance with external factors does not change the meaning of the entire story because of the context between the original scenario before and after the changed portion and unchanged portions.

The robot according to this embodiment reads aloud a story from a book or the like. The robot can dynamically change the contents to be read in accordance with the time of day or the season when the story is being read aloud and other external factors applied to the robot.

The robot according to this embodiment can read a picture book aloud while looking at it. For example, even when the season set to a story in the picture book being read is spring, when the current season during which the picture book is being read is autumn, the robot reads the story as if the season is autumn. During the Christmas season, Santa Claus appears as a character. At Halloween, the town is full of pumpkins.

Figure 10:
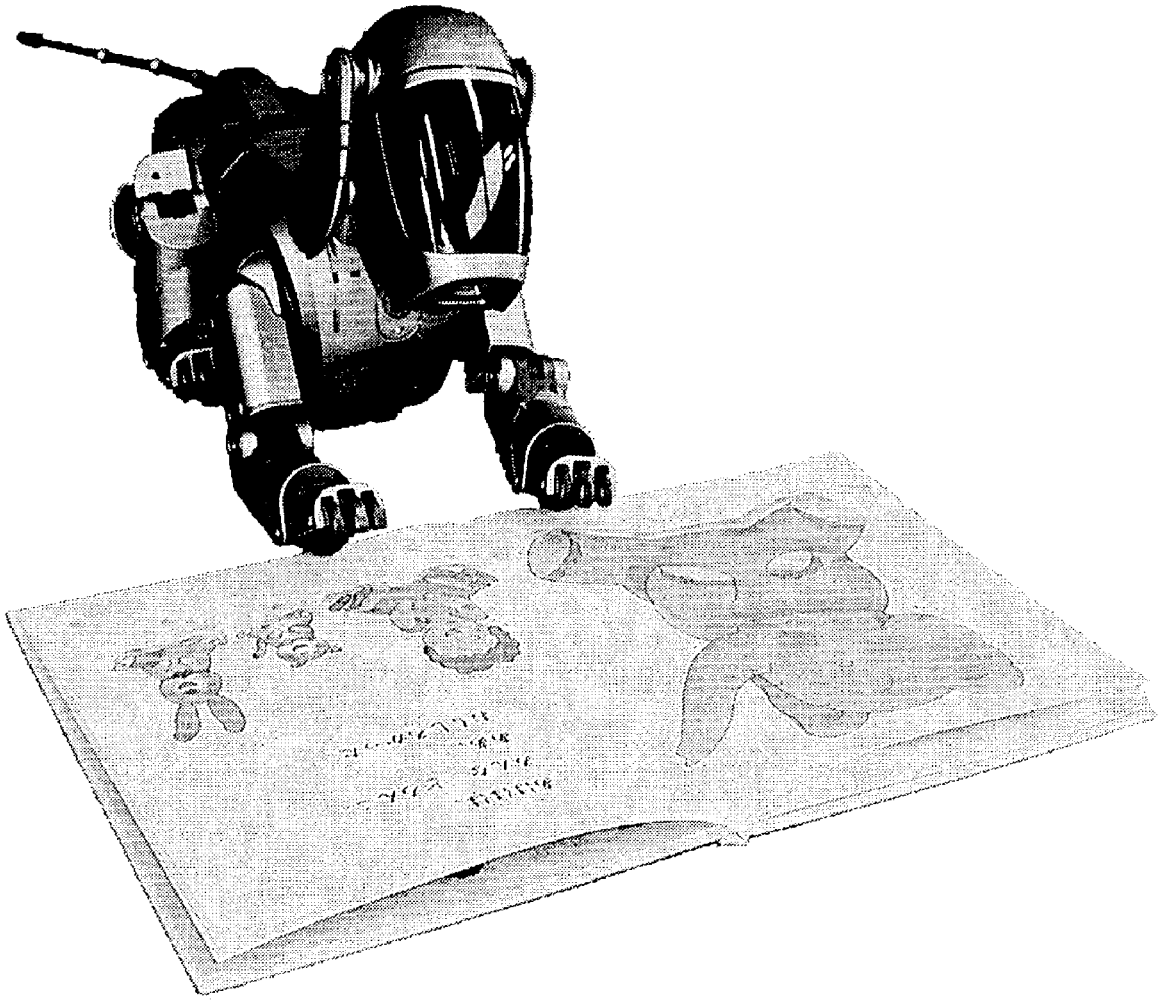
FIG. 10 shows how the mobile robot 1 reads a picture book aloud while looking at it.

FIG. 10 shows the robot 1 reading the picture book aloud while looking at it. When reading a text, the mobile robot 1 according to this embodiment has a "reading aloud mode" in which the operation of the body stops and the robot 1 reads the text aloud and a "dynamic mode" in which the robot 1 reads the text aloud while moving the front legs in accordance with the story development (described below). By reading the text aloud in the dynamic mode, the sense of realism is improved, and the text becomes more entertaining.

For example, the left and right pages are in different colors (that is, printing or image formation processing is performed so that the combination of colors differs for each page). The mobile robot 1 can specify which page is open by performing color recognition and can detect an appropriate passage to be read. Needless to say, by pasting a visual marker, such as a cybercode, to each page, the mobile robot 1 can identify the page by performing image recognition.

In FIGS. 12 to 17, examples of a story consisting of scenes 1 to 6 are shown. As is clear from the drawings, for scene 1, scene 2, and scene 6, a plurality of versions is prepared in accordance with the outside world, such as the time of day. The remaining scenes, namely, scene 3, scene 4, and scene 5, are not changed in accordance with the time of day or other external factors. Needless to say, even when a version of a scene seems to be greatly different from the original scenario in accordance with external factors, this version does not change the meaning of the entire story because of the context between the original scenario before and after the changed portion and unchanged portions.

In the robot, which reads the story aloud, external factors are recognized by the input unit and the input determination unit, and the scenario unit sequentially selects a scene in accordance with each external factor.

The mobile robot 1 can store beforehand the content to be read aloud in the ROM 23. Alternatively, the content to be read aloud can be externally supplied through a storage medium, such as a memory stick.

Alternatively, when the mobile robot 1 has means for connecting to a network, the content to be read aloud can be appropriately downloaded from a predetermined information distributing server. The use of the most recent content is facilitated by a network connection. Data to be downloaded includes not only the contents of a story, but also an operation program for operating the body in the dynamic mode and a display control program for controlling display by the eye lamps 19. Needless to say, a preview of the subsequent story can be inserted into the content or advertising content from other suppliers can be inserted.

The mobile robot 1 according to this embodiment can control switching of the scene through input means such as the pad switch. For example, the pad switch on the left-rear leg is pressed, and then the touch sensor on the back is pressed, thereby skipping to the subsequent scene. In order to proceed to further subsequent scenes, the pad switch on the left-rear leg is pressed by the number of proceeding steps, and then the touch sensor on the back is pressed.

In contrast, when returning to the previous scene, the pad switch on the right-rear leg is pressed, and then the touch sensor on the back is pressed. When returning to further previous scenes, the pad switch on the right-rear leg is pressed by the number of returning steps, and then the touch sensor on the pack is pressed.

When reading a text aloud, the mobile robot 1 according to this embodiment has the "reading aloud mode" in which the operation of the body stops and the mobile robot 1 reads the text aloud and the "dynamic mode" in which the mobile robot 1 reads the text aloud while moving the front legs in accordance with the story development. By reading the text aloud in the dynamic mode, the sense of realism is improved, and the text becomes more entertaining.

The mobile robot 1 according to this embodiment changes the display by the eye lamps 19 in accordance with a change of scene. Thus, the user can apocalyptically confirm which scene is being read aloud or that there is a change of scene in accordance with the display by the eye lamps 19.

Figure 18:
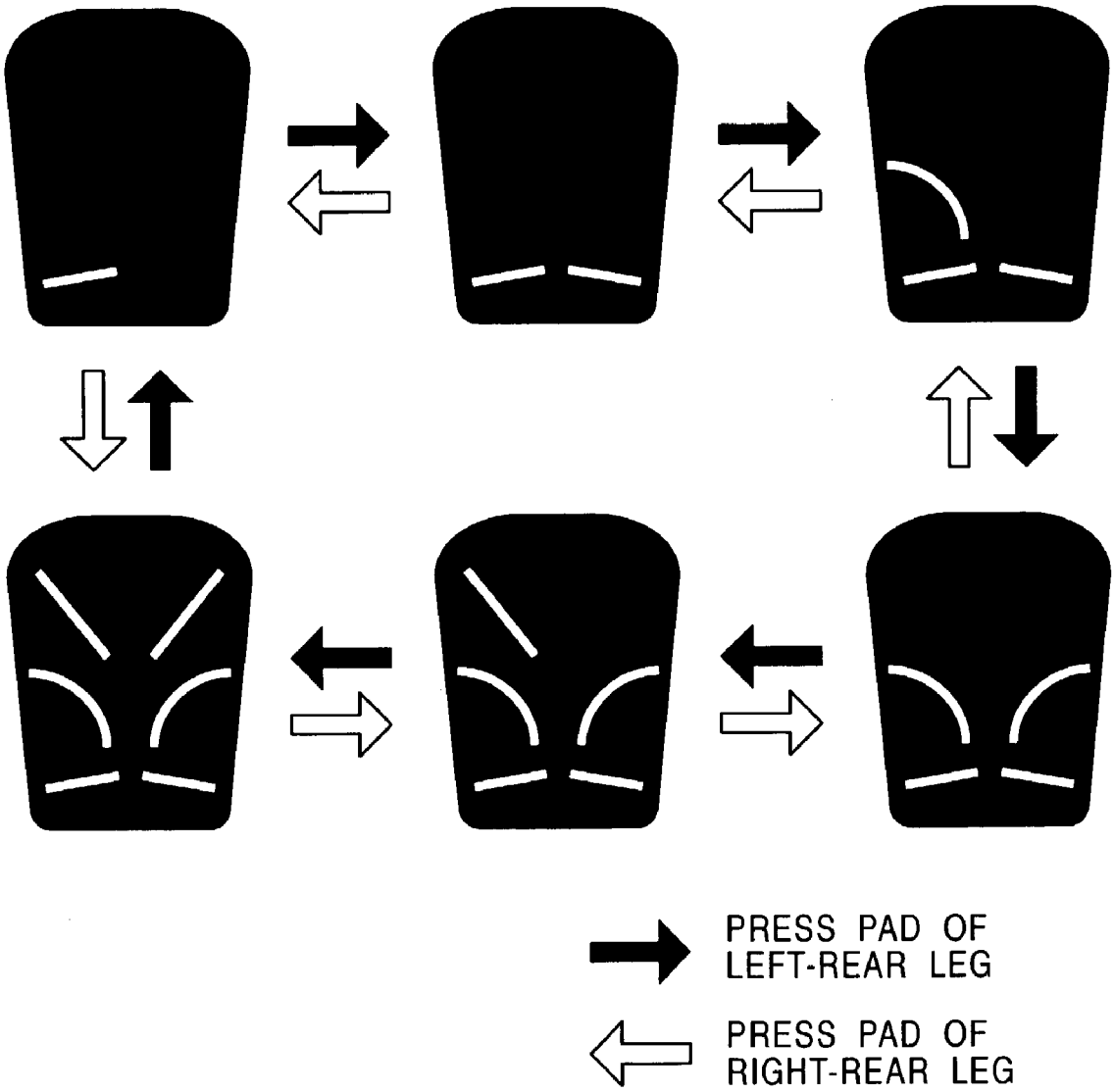
FIG. 18 illustrates an example of a scene displayed by eye lamps 19 in a reading aloud mode.
Figure 19:
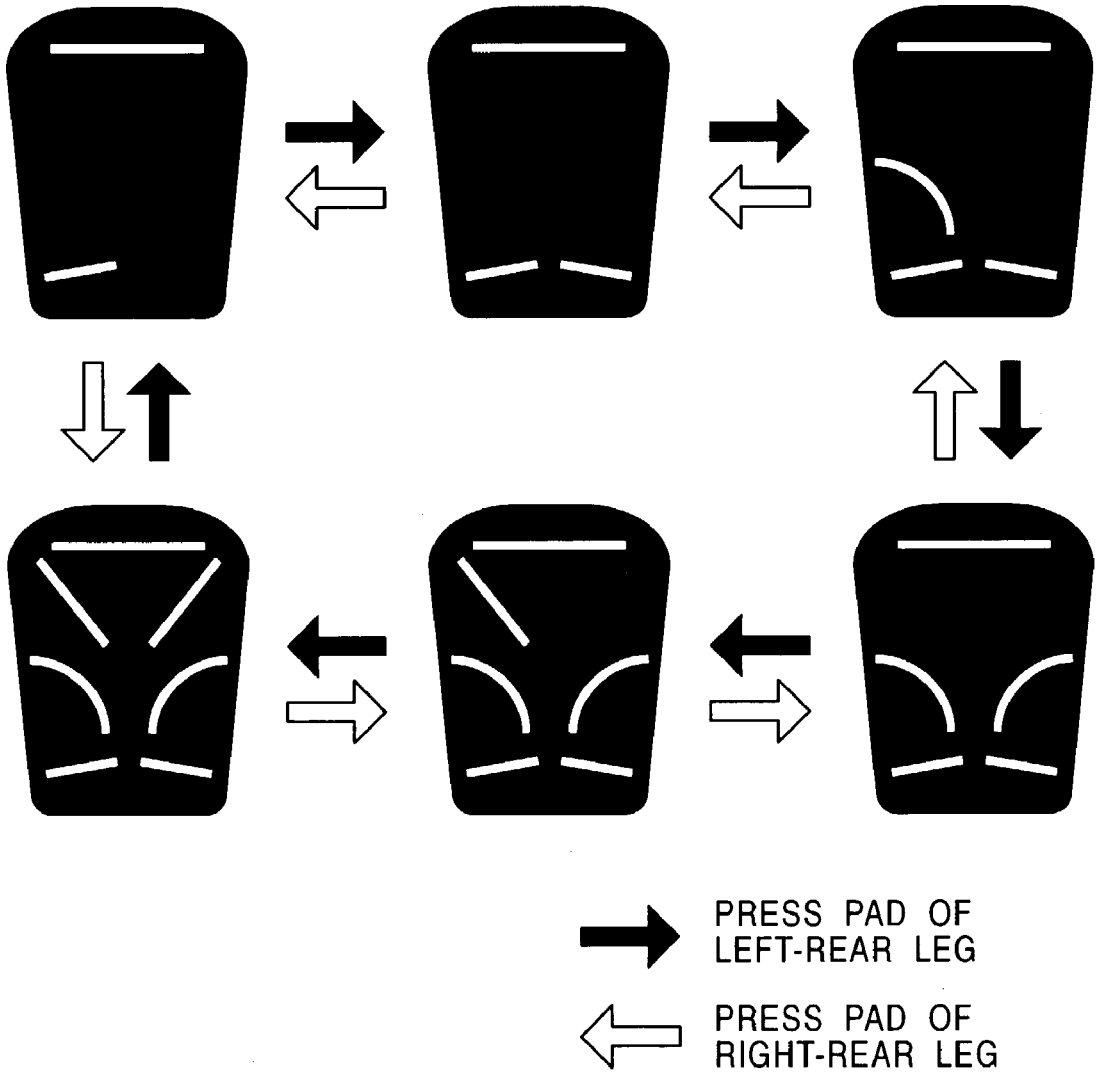
FIG. 19 illustrates an example of a scene displayed by the eye lamps 19 in a dynamic mode.

In FIG. 18, an example of the display by the eye lamps 19 in the reading aloud mode is shown. In FIG. 19, an example of the display by the eye lamps 19 in the dynamic mode is shown.

Examples of changes of a scenario (or versions of a scene) according to the season are shown as follows:

Spring
A butterfly is flitting around somebody walking.
Summer
Instead of the butterfly, a cicada is flying.
Autumn
Instead of the butterfly, a red dragonfly is flying.
Winter
Instead of the butterfly, it starts to snow.

Examples of changes of a scenario (or versions of a scene) according to the time are shown as follows:

Morning
The morning sun is dazzling. Eat breakfast.
Noon
The sun strikes down. Eat lunch.
Evening
The sun is almost setting in. Eat dinner.
Night
Eat late-night snack (noodles, pot noodles, etc.).

Examples of changes of a scenario (or versions of a scene) due to a public holiday or other special dates based on special events are shown as follows:

Christmas
Santa Claus is on his sleigh, which is pulled by reindeers, and the sleigh is crossing the sky.
People encountered say, "Merry Christmas!"
It may snow.
New Year
The robot greets the user with a "Happy New Year."
User's birthday
The robot writes and sends a birthday card to the user, and the robot reads the birthday card aloud.

By incorporating changes according to the season and the time and timely information into the story, it is possible to provide content having real-time features.

The robot may be in a good mood or a bad mood. When the robot is in a bad mood, the robot may not read a book. Instead of changing the story at random, reading is performed in accordance with autonomous external factors (the time, sense of the season, biorhythm, the robot's character, etc).

In this embodiment illustrated in the specification, examples of available events which can be used as external factors for the robot are summarized as follows:

(1) Communication with the user through the robot's body
(Ex) Patted on the head
When the robot is patted on the head, the robot obtains information about user's likes and dislikes and mood.
(2) Conceptual representation of the time and the season
(Ex. 1) Morning, noon, and evening; and types of meals (breakfast, lunch, and dinner)
(Ex. 2) Four seasons
Spring→Warm temperature, cherry blossoms, and tulips
Summer→Rain, hot
Autumn→Fallen leaves
Winter→New Year greeting
→At Christmas, Santa Claus appears.
→Rain changes to snow.
(3) Brightness/darkness of user's room
(Ex) When it is dark, a ghost appears.
(4) The robot's character, emotion, age, star sign, and blood type
(Ex. 1) The robot's way of speaking is changed in accordance with the robot's character.
(Ex. 2) The robot's way of speaking is changed to adult-like speaking or childlike speaking in accordance with the robot's age.
(Ex. 3) Tell the robot's fortune.
(5) Visible objects
(Ex. 1) The condition of the room
(Ex. 2) The user's location and posture (standing, sleeping, or sitting)
(Ex. 3) The outdoor landscape
(6) The region or country where the robot is.
(Ex) Although a picture book is written in Japanese, when the robot is brought to a foreign country, the robot automatically reads the picture book in that country's official language. For example, an automatic translation function is used.
(7) The robot's manner of reading aloud is changed in accordance with information input via a network.

(8) Direct speech input from a human being, such as the user, or speech input from another robot.

(Ex) In accordance with a name called out by the user, the name of a protagonist or another character is changed.

Text to be read aloud by the robot according to this embodiment can include books other than picture books. Also, rakugo (comic stories) and music (BGM) can be read aloud. The robot can listen to a text read aloud by the user or another robot, and subsequently the robot can read that text aloud.

(1) When Reading a Comic Story Aloud

A variation can be added to the original text of a classical comic story, and the robot can read this comic story aloud. For example, changes of expressions (motions) of heat or coldness according to the season can be expressed. By implementing billing and downloading through the Internet, an arbitrary piece of comic story data from a collection of classical comic stories can be downloaded, and the downloaded comic story can be told by the robot. The robot can obtain content to be read aloud using various information communication/transfer media, distribution media, and providing media.

(2) When Playing Music (BGM)

A piece of music BGM can be downloaded from a server through the Internet, and the downloaded music can be played by the robot. By learning user's likes and dislikes or by determining the user's mood, the robot can select and play an appropriate piece of BGM in the user's favorite genre or a genre corresponding to the current state. The robot can obtain content to be read aloud using various information communication/transfer media, distribution media, and providing media.

(3) When Reading Aloud a Text or a Text Which has been Read Aloud by Others

The robot reads aloud a novel (for example, Harry Potter series or a detective story).

The reading frequency interval (for example, everyday) and the reading unit per single reading (one chapter) are set. The robot autonomously obtains the necessary amount of content to be read at the required time.

Alternatively, a text read by the user or another robot can be input to the robot, and at a future date the robot can read the input text aloud. The robot may play a telephone game or a word-association game with the user or another robot. The robot may generate a story through a conversation with the user or another robot.

As shown in this embodiment, while the robot is operating in cooperation with the user in a work space shared with the user, such as a general domestic space, the robot may detect a change in the external factors, such as a change of time, a change of season, or a change in the user's mood, and may transform an action sequence. Accordingly, the user can have a stronger affection for the robot.

Although the present invention has been described with reference to the specific embodiment, it is evident that modifications and substitutions can be made by those skilled in the art without departing from the scope of the present invention.

In this embodiment, an authoring system according to the present invention has been described in detail by illustrating a four-legged walking pet robot which is modeled after a dog. However, the scope of the present invention is not limited to this embodiment. For example, it should be fully understood that the present invention is similarly applicable to a two-legged mobile robot, such as a humanoid robot, or a mobile robot which does not use a legged formula.

In short, the present invention has been described by illustrative examples, and it is to be understood that the present invention is not limited to the specific embodiments thereof. The scope of the present invention is to be determined solely by the appended claims.

INDUSTRIAL APPLICABILITY

According to the present invention, it is possible to provide a superior legged robot which can perform various action sequences using limbs and/or a trunk, an action control method for the legged robot, and a storage medium.

According to the present invention, it is possible to provide a superior legged robot of a type which can autonomously form an action plan in response to external factors without direct command input from an operator and which can perform the action plan; an action control method for the legged robot; and a storage medium.

According to the present invention, it is possible to provide a superior legged robot which can detect external factors, such as a change of time, a change of season, or a change in a user's mood, and which can transform an action sequence while operating in cooperation with the user in a work space shared with the user; an action control method for the legged robot; and a storage medium.

When reading a story printed in a book or other print media or recorded in recording media or when reading a story downloaded through a network, an autonomous legged robot realizing the present invention does not simply read every single word as it is written. Instead, the robot dynamically alters the story using external factors, such as a change of time, a change of season, or a change in the user's mood, as long as the altered story is substantially the same as the original story. As a result, the robot can read aloud the story whose contents would differ every time the story is told.

Since the robot can perform unique actions, the user can continue to be with the robot without getting bored.

According to the present invention, the world of the autonomous robot extends to the world of reading. Thus, the robot's understanding of the world can be enlarged.

The invention claimed is:

1. A legged robot which operates in accordance with a predetermined action sequence, comprising:

input means for detecting an external factor;

option providing means for providing changeable options concerning at least a portion of the action sequence;

input determination means for selecting an appropriate option from among the options provided by the option providing means in accordance with the external factor detected by the input means; and action control means for performing the action sequence, which is changed in accordance with a determination result by the input determination means.

2. A legged robot according to claim 1, further comprising content obtaining means for obtaining external content for use in performing the action sequence.

3. A legged robot according to claim 1, wherein the external factor detected by the input means comprises an action applied by a user.

4. A legged robot according to claim 1, wherein the external factor detected by the input means comprises a change of time or season or reaching a special date.

5. A legged robot according to claim 1, wherein the action sequence is reading a text aloud.

6. A legged robot according to claim 5, wherein, in the action sequence, a scene to be read aloud is changed in response to an instruction from a user, the instruction being detected by the input means.

7. A legged robot according to claim 6, further comprising display means for displaying a state, wherein the display means changes a display format in accordance with a change of scene to be read aloud.

8. A legged robot according to claim 1, wherein the action sequence is a live performance of a comic story.

9. A legged robot according to claim 1, wherein the action sequence comprises playback of music data.

10. A robot apparatus with a movable section, comprising:

external factor detecting means for detecting an external factor;

speech output means for outputting a speech utterance by the robot apparatus;

storage means for storing a scenario concerning the contents of the speech utterance; and scenario changing means for changing the scenario, wherein the scenario is uttered by the speech output means while the scenario is changed by the scenario changing means in accordance with the external factor detected by the external factor detecting means.

11. A robot apparatus according to claim 10, wherein the movable section is actuated in accordance with the contents of the scenario when uttering the scenario.

12. An action control method for a legged robot which operates in accordance with a predetermined action sequence, comprising:

an input step of detecting an external factor;

an option providing step of providing changeable options concerning at least a portion of the action sequence;

an input determination step of selecting an appropriate option from among the options provided in the option providing step in accordance with the external factor detected in the input step; and an action control step of performing the action sequence, which is changed in accordance with a determination result in the input determination step.

13. An action control method for a legged robot according to claim 12, further comprising a content obtaining step of obtaining external content for use in performing the action sequence.

14. An action control method for a legged robot according to claim 12, wherein the external factor detected in the input step comprises an action applied by a user.

15. An action control method for a legged robot according to claim 12, wherein the external factor detected in the input step comprises a change of time or season or reaching a special date.

16. An action control method for a legged robot according to claim 12, wherein the action sequence is reading a text aloud.

17. An action control method for a legged robot according to claim 16, wherein, in the action sequence, a scene to be read aloud is changed in response to an instruction from a user, the instruction being detected in the input step.

18. An action control method for a legged robot according to claim 17, further comprising a display step of displaying a state, wherein the display step changes a display format in accordance with a change of scene to be read aloud.

19. An action control method for a legged robot according to claim 12, wherein the action sequence is a live performance of a comic story.

20. An action control method for a legged robot according to claim 12, wherein the action sequence comprises playback of music data.

21. A storage medium which has physically stored therein computer software in a computer-readable format, the computer software causing a computer system to execute action control of a legged robot which operates in accordance with a predetermined action sequence, the computer software comprising:

an input step of detecting an external factor;

an option providing step of providing changeable options concerning at least a portion of the action sequence;

an input determination step of selecting an appropriate option from among the options provided in the option providing step in accordance with the external factor detected in the input step; and an action control step of performing the action sequence, which is changed in accordance with a determination result in the input determination step.

* * * * *